US005769016A

United States Patent [19]

Shinozuka

[11] Patent Number: 5,769,016

[45] Date of Patent: Jun. 23, 1998

[54] BOBBIN EXCHANGE JUDGING APPARATUS

[75] Inventor: Toshinobu Shinozuka, Tokyo, Japan

[73] Assignee: Juki Corporation, Tokyo, Japan

[21] Appl. No.: 797,489

[22] Filed: Feb. 7, 1997

[30] Foreign Application Priority Data

Feb. 9, 1996 [JP] Japan ..... 8-048191

[51] Int. Cl.[6] ..... D05B 19/12; D05B 59/02; D05B 59/04

[52] U.S. Cl. ..... 112/470.05; 112/180; 112/278; 112/279

[58] Field of Search ..... 112/278, 273, 112/470.01, 470.02, 470.05, 186, 180, 279

[56] References Cited

U.S. PATENT DOCUMENTS 4,359,953 11/1982 Martell et al. ..... 112/470.02
5,020,461 6/1991 Hanyu et al. ..... 112/278
5,143,004 9/1992 Mardix et al. ..... 112/278 X
5,322,029 6/1994 Fujita ..... 112/278

*Primary Examiner*—Peter Nerbun
*Attorney, Agent, or Firm*—Morgan & Finnegan LLP

[57] ABSTRACT

A residual thread removing device detects an amount of thread left in a bobbin of a sewing machine. The bobbin exchange time setting means sets a time to exchange a bobbin set in the sewing machine with a new one to a bobbin exchange time at which an amount of thread providing a minimum of unusable thread is left in the bobbin, on the basis of the detected thread amount. With such an arrangement, a bobbin exchange time can be set to an optimal time at which a waste of the thread in a bobbin is minimized, irrespective of a kind of thread and/or thread count.

5 Claims, 26 Drawing Sheets

FIG. 18(a)
FIG. 18(b)
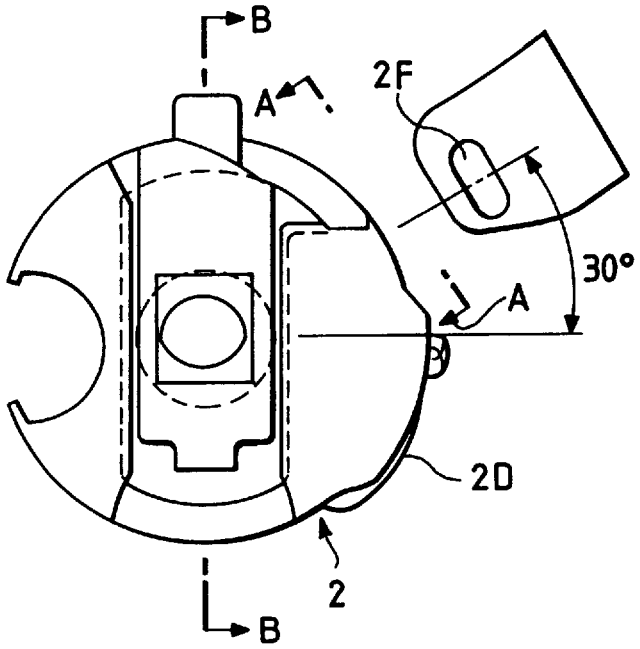
FIG. 18(c)
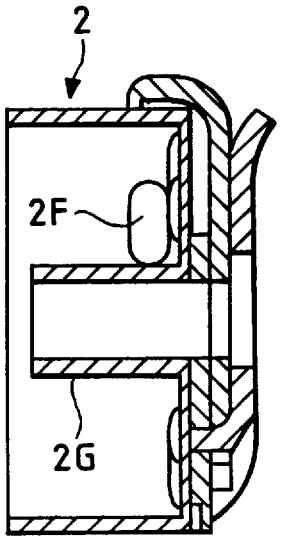

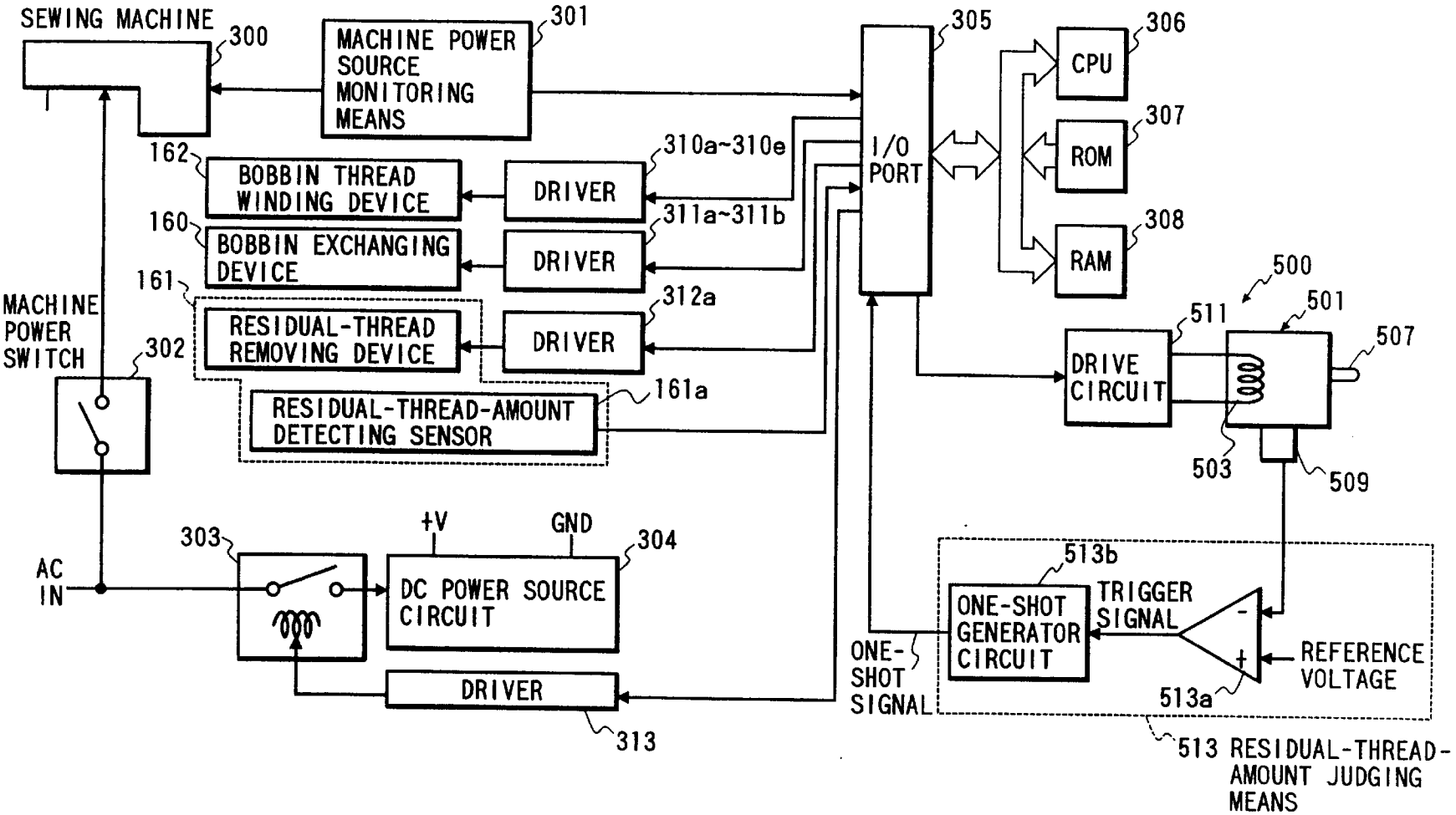
FIG. 26
SEWING MACHINE
300
MACHINE POWER SOURCE MONITORING MEANS
301
CPU
306
ROM
307
RAM
308
I/O PORT
305
DRIVE CIRCUIT
511
500
501
507
503
509
REFERENCE VOLTAGE
513a
TRIGGER SIGNAL
513b
ONE-SHOT GENERATOR CIRCUIT
513 RESIDUAL-THREAD-AMOUNT JUDGING MEANS
ONE-SHOT SIGNAL
310a~310e
311a~311b
312a
161a
DRIVER
DRIVER
DRIVER
BOBBIN THREAD WINDING DEVICE
BOBBIN EXCHANGING DEVICE
RESIDUAL-THREAD REMOVING DEVICE
RESIDUAL-THREAD-AMOUNT DETECTING SENSOR
162
160
161
302
MACHINE POWER SWITCH
AC IN
303
+V
GND
DC POWER SOURCE CIRCUIT
304
DRIVER
313

BOBBIN EXCHANGE JUDGING APPARATUS

BACKGROUND OF THE INVENTION

The present invention relates to a bobbin exchange judging apparatus.

Some types of conventional sewing machines are each provided with a residual-thread amount detecting device in order to prevent a bobbin thread from being used up during a sewing operation. The residual-thread amount detecting device detects an amount of residual thread wound around the shaft of a bobbin in a shuttle body, and informs an operator of a bobbin exchange time. Examples of the conventional residual-thread amount detecting device are described in Japanese Utility Model Application Laid-Open No. Sho 63-136591 and Japanese Utility Model Publication No. Hei. 7-1113.

In the residual-thread amount detecting device disclosed in Japanese Utility Model Publication No. Hei. 7-1113, when a sewing operation ends and a sewing machine stops at a predetermined position, a rotary solenoid, for example, operates to move a detecting bar. The end of the detecting bar is brought into the circumference of the thread wound on the bobbin. Then, the solenoid is operated again to return the detecting bar to its original position. When an amount of the thread left in the bobbin is large, a distance the detecting bar is moved is short. In this case, a bobbin exchange request signal (thread consumption detect signal) for informing an operator of the necessity of supplying a thread is not generated. The bobbin thread is progressively used, and an amount of the residual thread is decreased. With decrease of the residual thread amount, the outside diameter of the thread wound around the bobbin shaft is small, and a moving distance of the detecting bar gradually increases. When the moving distance of the detecting bar reaches a predetermined distance, a bobbin exchange request signal is generated to inform an operator of the necessity of supplying a bobbin thread. Specifically, when the number of layers of the thread wound around the bobbin shaft is one or smaller than one, a bobbin exchange request signal is generated. In response to the request signal, an operator exchanges the bobbin with a new one. The residual thread in the bobbin taken out of the shuttle body is discarded.

As described above, in the bobbin exchange judging apparatus, the detecting bar is brought into contact with the circumference of the thread wound on the bobbin, more exactly the bobbin shaft. When the number of the layers of the thread wound on the bobbin is one or smaller than one, the old bobbin is exchanged with a new one. The residual thread is discarded, but is long enough to form several seam patterns. Discarding the residual thread is uneconomical and leads to increase of the sewing cost.

In designing the residual-thread amount detecting device, a change of the kind of thread and/or thread count is not taken into consideration. When a high count thread, for example, is used and a currently used bobbin is exchanged with a new one, an operator carries out the following operation in order to minimize the amount of residual thread. That is, he receives a bobbin exchange request signal and estimates the number of seam patterns to be formed after the generation of the bobbin exchange request signal, and exchanges the old bobbin with a new one. This operation requires some skill.

SUMMARY OF THE INVENTION

Accordingly, an object of the present invention is to provide a bobbin exchange judging apparatus which automatically sets a bobbin exchange time to an optimal time at which a waste of a thread in a bobbin is minimized, irrespective of a kind of thread and/or thread count, and does not require any skill of an operator for the bobbin exchanging operation.

In the bobbin exchange judging apparatus according to a first aspect, the residual-thread amount detecting means detects an amount of thread left in a bobbin after an amount of thread is taken out of a sewing machine. The bobbin exchange time setting means sets a time to exchange a bobbin in the sewing machine with a new one to a bobbin exchange time at which an amount of thread providing a maximum of sewing is left in the bobbin, on the basis of the detected thread amount. Stated another way, a minimum of unusable thread is left on the bobbin. With such an arrangement, a bobbin exchange time can be set to an optimal time at which a waste of the thread in a bobbin is minimized, irrespective of a kind of thread and/or thread count.

In a bobbin exchange judging apparatus according to the second aspect, a bobbin thread winding device winds a predetermined amount of thread around the bobbin shaft used for sewing operation. The residual-thread amount detecting means detects an amount of thread left in a bobbin after an amount of thread is removed from the bobbin on which bobbin a predetermined amount of thread is wound by the thread winding device when the bobbin is used for a sewing operation and taken out of a shuttle body. The bobbin exchange time setting means sets a time to exchange a bobbin with a new one, the bobbin having a predetermined amount of thread wound thereon by the thread winding device and being set in the sewing machine, to a bobbin exchange time at which such an amount of thread providing a maximum of sewing is left in the bobbin (i.e., a minimum of unusable thread is left on the bobbin), on the basis of a seam pattern and the detected thread amount. For a bobbin on which a thread is manually wound or an unknown thread winder, the bobbin exchange judging apparatus judges that the setting of a bobbin exchange time will be incorrect, and does not set the bobbin exchange time until the related processes will be completed. For the bobbin having undergone the necessary processes, the bobbin exchange judging apparatus judges that the setting of a bobbin exchange time will be correct, and sets a bobbin exchange time to an optimal time at which a waste of the thread in a bobbin is minimized, with respect to kinds of thread an/or thread counts.

In the bobbin exchange judging apparatus according to the third aspect, when the bobbin-thread amount detecting device generates a bobbin exchange request signal indicating that a small amount of thread is left, the bobbin exchange time setting means judges whether or not the bobbin exchange time set is reached. The amount of residual thread is checked twice by the residual-thread amount detecting device and also the bobbin exchange time setting means. In cases where the setting and judgement on the bobbin exchange time are based on, for example, the number of stitchings, presence of dummy stitchings possibly hastens the bobbin exchange time setting means to judge the bobbin exchange time. Such an error can be eliminated by the use of the residual-thread amount detecting device for detecting an actual amount of residual thread independently of the dummy stitchings.

In the bobbin exchange judging apparatus according to the fourth aspect, when the seam-pattern change recognizing means recognizes a change of a seam pattern, the bobbin exchange time setting means resets the already set bobbin exchange time to another bobbin exchange time on the basis of an amount of thread left in the bobbin, which is detected anew. Therefore, no problems arise if the seam pattern is changed.

BRIEF DESCRIPTION OF THE DRAWINGS

FIG. 18(*a*) is a front view of the bobbin case, FIG. 18(*b*) is a cross sectional view taken on line A—A, and FIG. 18(C) is a cross sectional view taken on line B—B.

FIG. 26 is a block diagram showing the automatic bobbin-thread supplying apparatus.

Figure 38A:
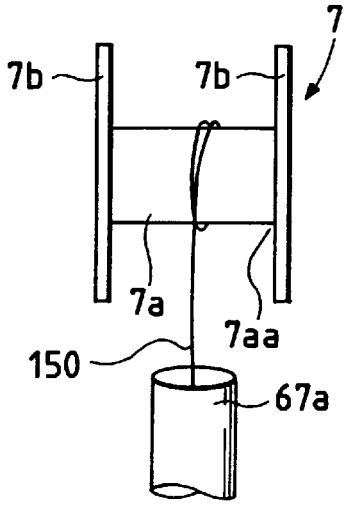
FIGS. 38(*a*) to 38(*c*) show how to wind a thread on the bobbin by the bobbin thread winding device, and FIG. 38(*a*)
Figure 38B:
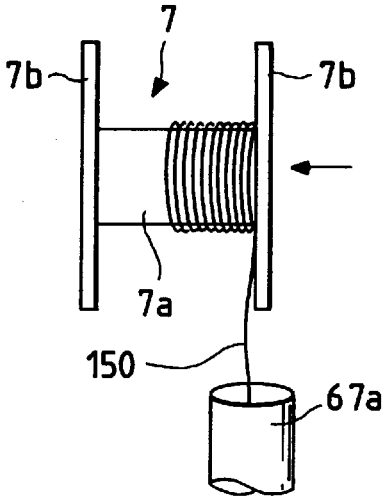
Figure 38C:
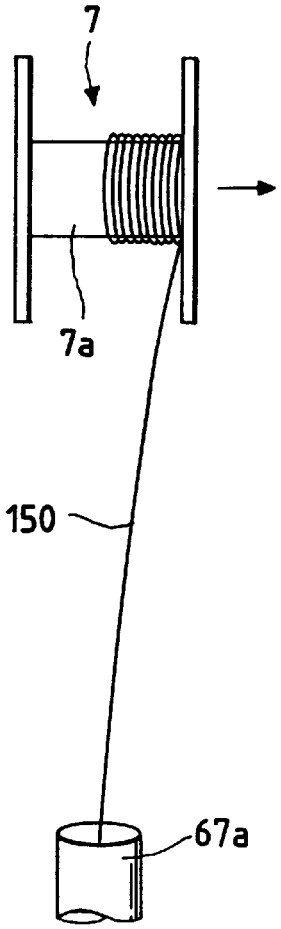

shows the operation of the winding device when a thread starts to get wound round the bobbin, FIG. 38(*b*) shows the operation of the same following the FIG. 38(*a*) operation, and FIG. 38(*c*) shows the operation thereof following the FIG. 38(*b*) operation.

Figure 39:
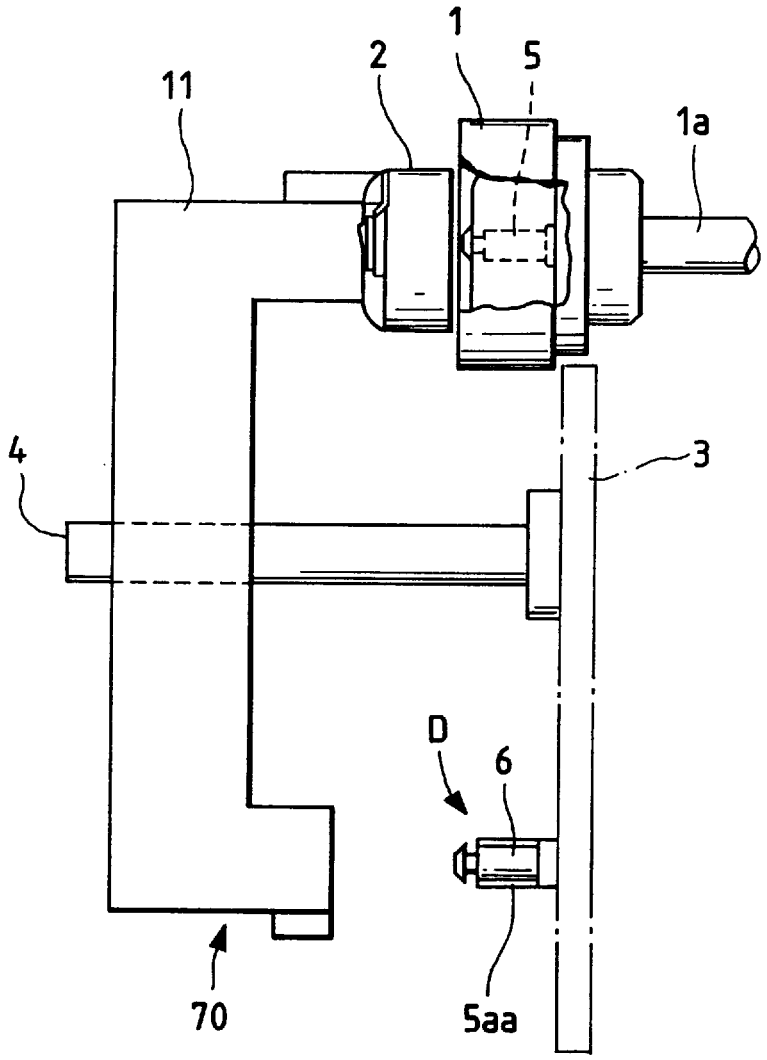

FIG. 39 is a right side view showing a key portion of the bobbin exchanging device when a current to the respective devices is interrupted.

DETAILED DESCRIPTION OF THE PREFERRED EMBODIMENTS

Figure 1:
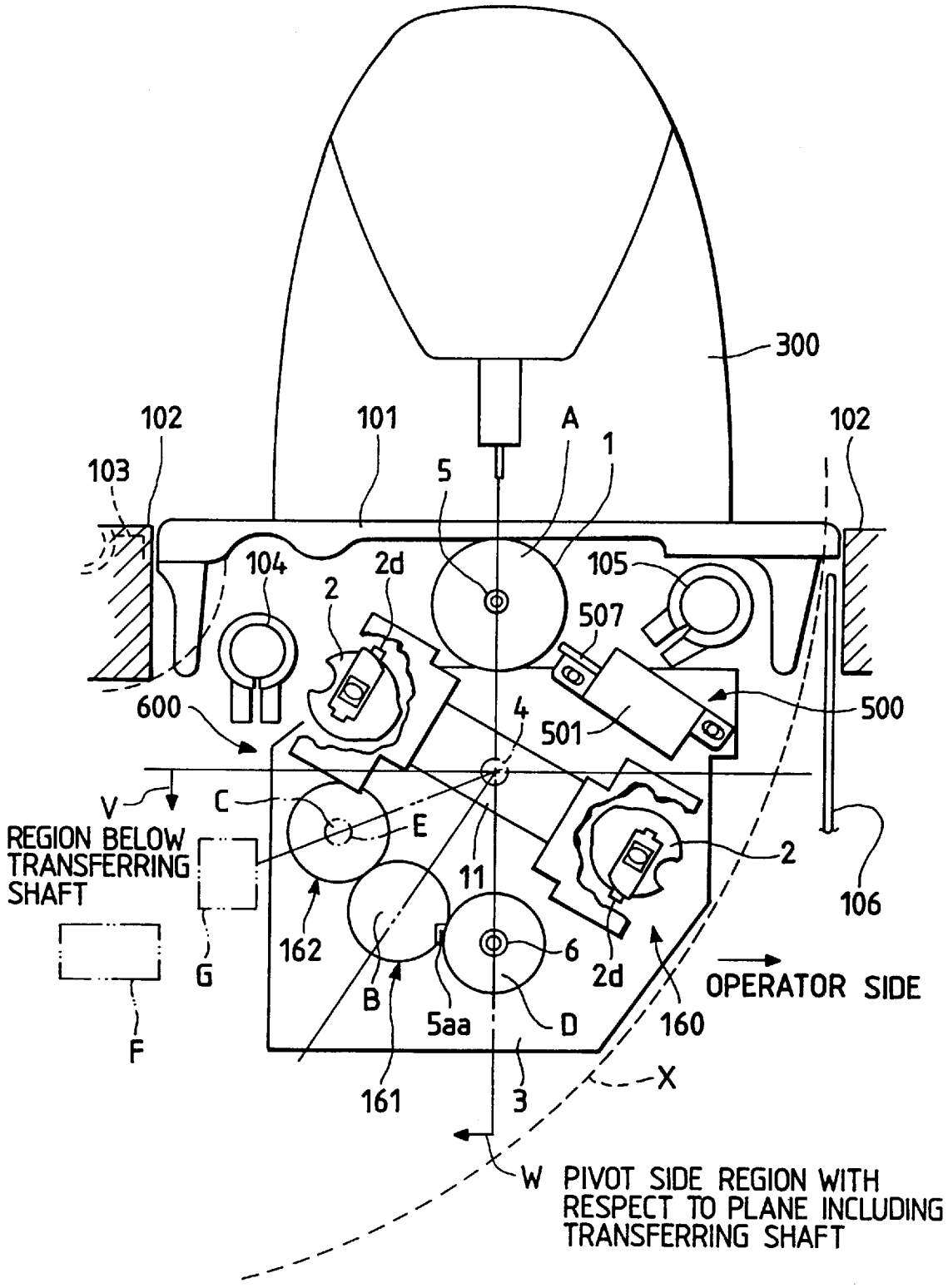
FIG. 1 is a front view showing an automatic bobbin-thread supplying apparatus according to an embodiment of the present invention.

The preferred embodiment of the present invention will be described with reference to the accompanying drawings. An automatic bobbin-thread supplying apparatus incorporating the present invention, as shown in FIG. 1, is located under a machine bed 101. The automatic bobbin-thread supplying apparatus comprises a bobbin thread winding device (including a thread catching and a thread cutting device) 162, a residual thread removing device 161, a bobbin exchanging device 160, and a residual-thread amount detecting device 500.

The bobbin exchanging device 160 holds a bobbin case with a bobbin case holding means, and can move it to a bobbin thread winding position C of the bobbin thread winding device 162, which faces a locus of the bobbin case holding means, a residual-thread-amount removing position B of the residual thread removing device 161, a shuttle position A (bobbin case exchanging position), and a bobbin case exchanging position D of a dummy shaft (bobbin case holding means) 6.

The bobbin thread winding position C, as shown in FIG. 1, is located within a region V under a transferring shaft 4 and a side of a pivot 103 which the machine bed 101 is turned to rise from a perpendicular plane along the line of that shaft. The residual thread removing position B is located below the bobbin thread winding position C. The residual thread removing position B lies at a retract position to which the bobbin case holding means is retracted, when it is viewed in the transferring shaft direction (perpendicular to the paper of FIG. 1 of the drawing). The bobbin thread winding position C lies at a position slightly advanced from the retract position of the bobbin case holding means (or a position slightly advanced to the paper of FIG. 1) when it is viewed in the transferring shaft direction. The bobbin case exchanging position D lies right under the shuttle position A.

In FIG. 1, reference numeral 102 designates a machine table; 106, an oil pan; 104 and 105, lower shafts; and X, a locus traced by the outer periphery of the machine head when the machine head is raised.

Figure 2:
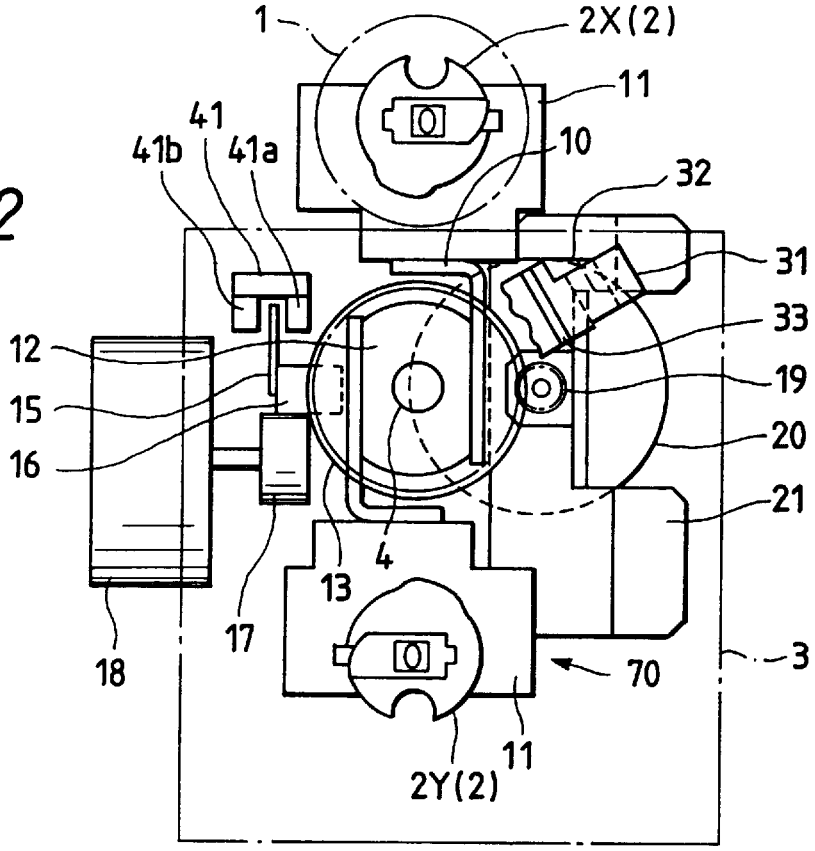
FIG. 2 is a front view showing a bobbin exchanging device used in the automatic bobbin-thread supplying apparatus.

The bobbin exchanging device 160 will be described with reference to FIGS. 2 to 6. In those figures, reference numeral 1 designates a shuttle body in which a bobbin case 2 is to be set; 1*a*, a shuttle shaft; and 3, a base plate serving as a support. The base plate 3 stands erect on a main base mounted on the machine body, and disposed right under the shuttle 1. A fixed end 4*a* of the transferring shaft 4, which extends in parallel with the shuttle shaft 1*a*, is fixed to the base plate 3 in a cantilever fashion. A transferring block 12 is rotatably and slidably coupled with a portion of the transferring shaft 4, which is closer to the distal end 4*b* of the transferring shaft 4 (opposite to the portion thereof coupled with the base plate 3). As best illustrated in FIG. 2, the circumference outer surface of the transferring block 12 is axially cut at two locations in a state that the cut surfaces are confronted with each other. One of the leg portions of each of L-shaped transferring plates 10 is fixed to the corresponding cut surface of the transferring block 12. The other leg portions of the L-shaped transferring plates 10 are confronted with each other with respect to the axial line of the transferring shaft 4.

Two holder portions 11 are provided, which are L shaped in cross section. One of the leg portions of each holder portion 11 extends toward the shuttle 1. One of the ends of each of holder portions 11 is fixed to the corresponding L-shaped transferring plate 10. The other end of each holder portion 11 is firmly coupled with bobbin case holding means (not shown) for catching the bobbin case and releasing it from being caught thereby. The bobbin case holding means may be any means if it can be set to and taken out of an opposed member (e.g., the shuttle 1). Examples of the bobbin case holding means are a pair of electromagnetic heads described in Japanese Patent Application Laid-Open No. Hei. 5-192476, entitled "Automatic Bobbin-Thread Supplying Apparatus" or Japanese Patent Application Laid-Open No. Hei. 6-304370, filed by the Applicant of the present patent application and entitled "Automatic Bobbin-Thread Supplying Apparatus for a Sewing Machine", and a lever pawl described Japanese Patent Application Laid-Open No. Hei. 6-304369, filed by the Applicant of the present patent application and entitled "Automatic Bobbin-Thread Supplying Apparatus for a Sewing Machine".

Returning to FIGS. 2 to 6, a rotary gear 13 is fixed onto the outer surface of the transferring block 12. The rotary gear 13 is in mesh with a long drive gear 19 extended to the shuttle shaft 1*a*. One end of the drive gear 19 is rotatably supported by a portion of a motor mounting plate 21 mounted on the base plate 3, the portion being extended to the other end of the transferring shaft. The other end of the drive gear is directly coupled with the output shaft of a rotation motor 20, which is fixed to the motor mounting plate 21.

When the rotation motor 20 is turned, a rotary arm 70 is driven to turn through the drive gear 19 and the rotary gear 13. The rotary arm 70 is constructed with the transferring block 12, the L-shaped transferring plates 10, and the holder portions 11. In the present embodiment, the rotary arm 70 is allowed to turn when it is at a retract position where it is retracted from the shuttle 1 (FIGS. 3 to 5).

A stop ring (not shown), for example, is fixed to a portion of the outer surface of the transferring block 12, which is closer to the fixed end of the transferring shaft 4 than the rotary gear 13. A movable collar 14 is rotatably supported on the outer surface of the transferring block 12 between the rotary gear 13 and the stop ring.

Figure 3:
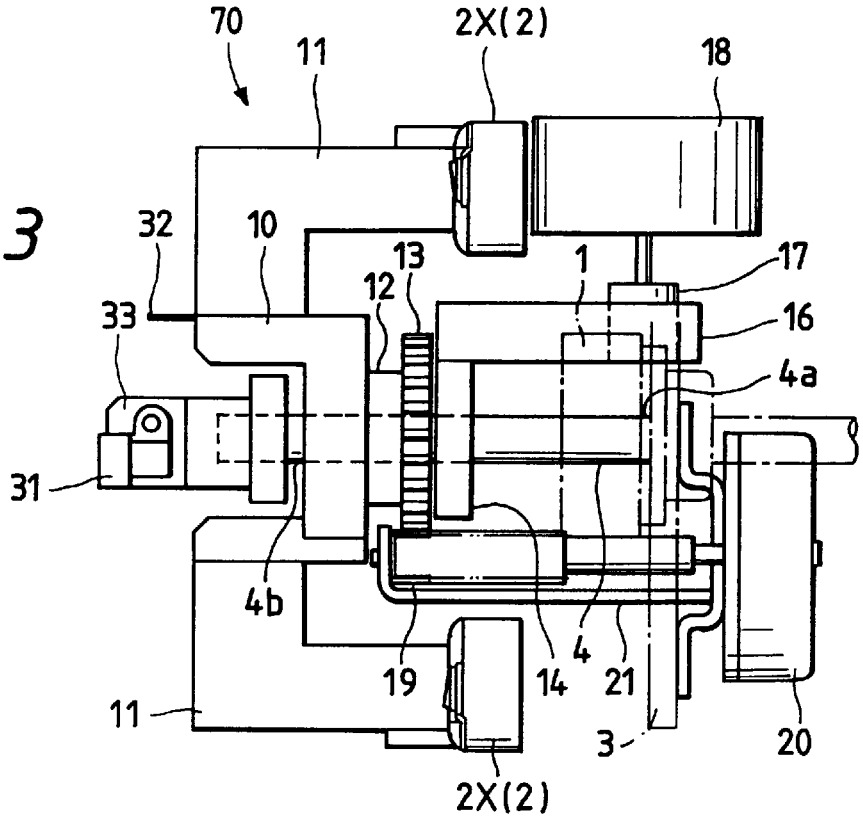
FIG. 3 is a plan view showing the bobbin exchanging device.
Figure 4:
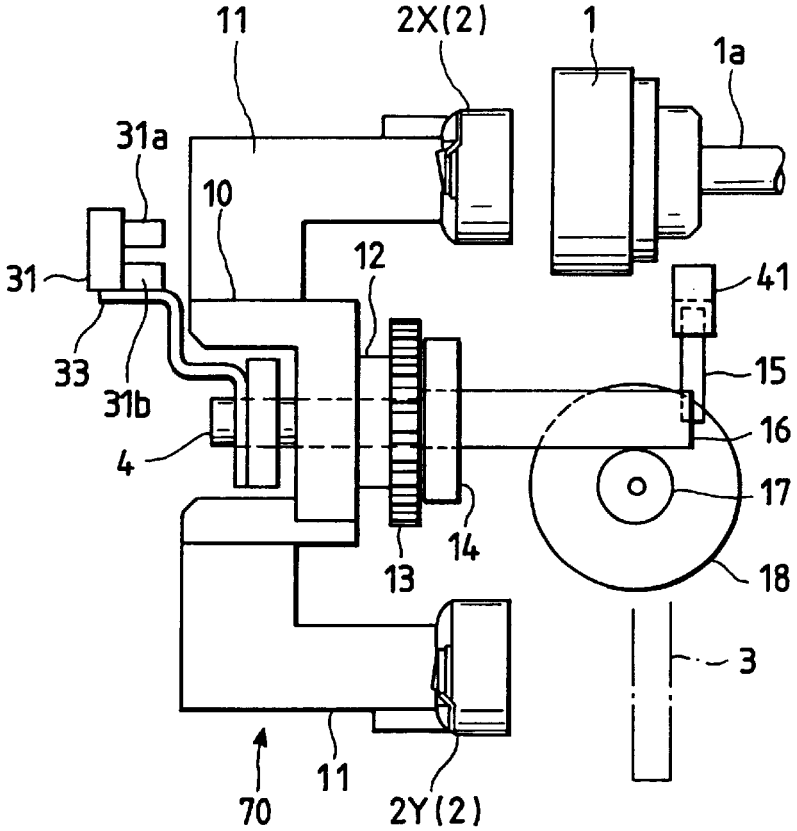
FIG. 4 is a right side view showing a linear movement mechanism in the bobbin exchanging device.
Figure 5:
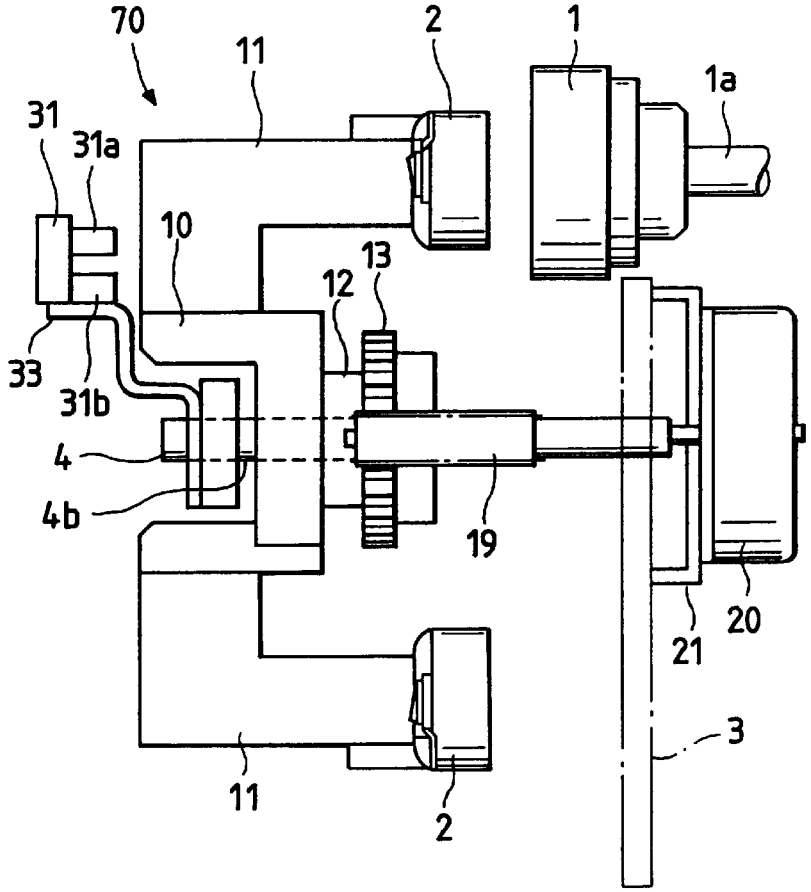
FIG. 5 is a right side view showing a rotation mechanism in the bobbin exchanging device.

As shown in FIGS. 2 to 4, one of the ends of a rack 16 which is supported movable in parallel with the shuttle shaft 1*a* is fastened to the movable collar 14. The other end of the rack 16 is in mesh with a pinion 17. The pinion 17 is fastened to the output shaft of a movement motor 18.

When the movement motor 18 is driven to turn, the movable collar 14 and the rotary arm 70, together with the rack 16, are driven to move in the axial direction of the transferring shaft 4, through the pinion 17. Thus, the rotary arm 70 is rotatable about the transferring shaft 4 and movable along the shaft 4.

A sensor mounting plate 33 is mounted on the open end of the transferring shaft 4. A rotation sensor 31 comprises a light emitting element 31*a* and a photo sensing element 31*b*. As shown in FIGS. 2 and 3, a sensor plate 32 is firmly attached to the rotary arm 70. The rotation sensor 31 and the sensor mounting plate 33 are adjusted in position so that when the rotary arm 70 is turned, the sensor plate 32 passes between the light emitting element 31*a* and the photo sensing element 31*b*.

As shown in FIGS. 2 and 4, a movement sensor 41 the construction of which is similar to that of the rotation sensor 31 is mounted on the base plate 3. The movement sensor 41 comprises a light emitting element 41*a* and a photo sensing element 41*b*. A sensor plate 15 is fastened to the rack 16. The translation sensor 41 and the sensor plate 15 are adjusted in position so that when the rotary arm 70 is translated, the sensor plate 15 passes between the light emitting element 41*a* and the photo sensing element 41*b* of the movement sensor 41.

When the bobbin case holding means moves to the retract position, the sensor plate 15 is placed between the light emitting element 41*a* and the photo sensing element 41*b* of the movement sensor 41. As a result, the arrival of the bobbin case holding means at the retract position is detected. Then, the searching for an original point is performed. The bobbin case holding means is turned at the retract position, and the sensor plate 32 is placed between the light emitting element 31*a* and the photo sensing element 31*b* of the rotation sensor 31. This position of the sensor plate 32, for instance, is referred to be an original position. The bobbin case holding means rotates, so that it is returned to the original position. Where the rotation motor 20 is a pulse motor, the bobbin case holding means may be moved to the shuttle position A, the bobbin thread winding position C, the residual thread removing position B, and the bobbin case exchanging position D on the basis of counts of a counter which counts the number of pulses output from the pulse motor.

In the present embodiment, when the rotary arm 70 is at the retract position and the bobbin case 2 held by the bobbin case holding means is confronted with the bobbin case 2, this confronting position of the bobbin case 2 is determined to be an original position of the rotary arm 70 (bobbin case holding means).

Figure 6:
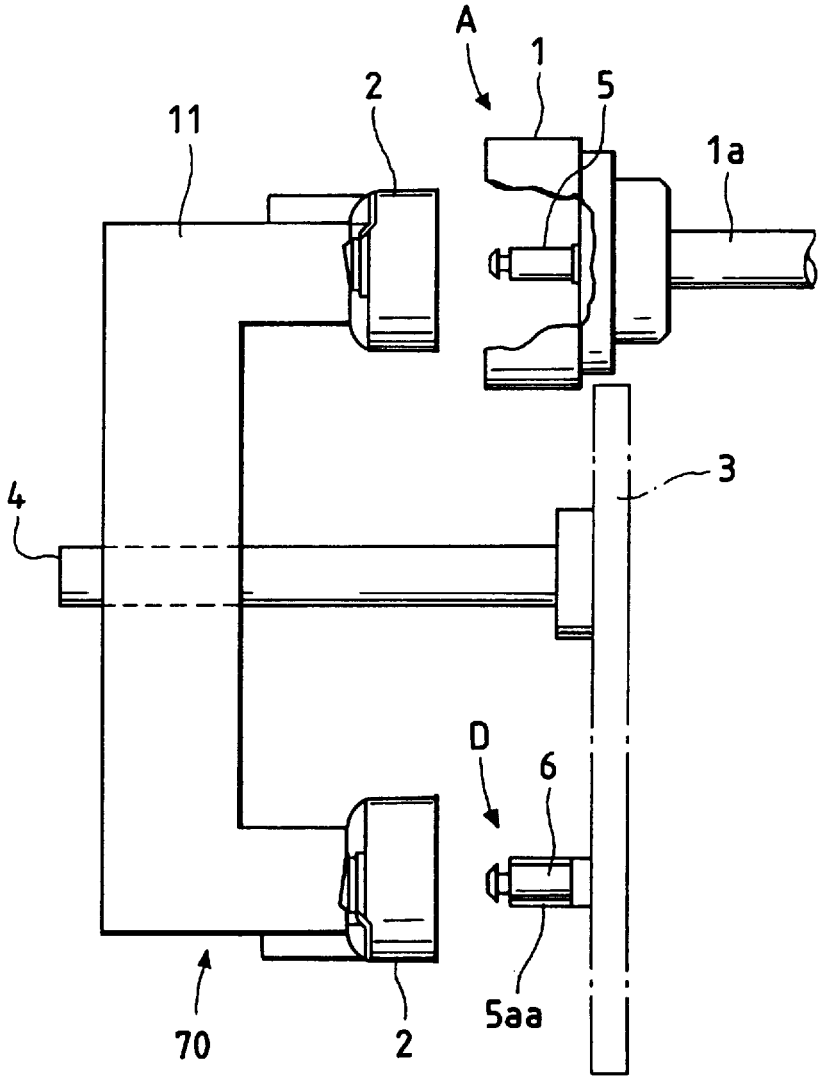
FIG. 6 is a right side view useful in explaining a dummy position and a dummy shaft in the bobbin exchanging device.

The dummy shaft 6 is a bobbin case holding means and is fixed at the position D which faces the locus traced by the bobbin case holding means on the base plate 3 and is located just under the shuttle 1 as shown in FIG. 1. As best illustrated in FIG. 6, the structure of the dummy shaft 6 has the same structure as of the shuttle shaft 5. When the bobbin case 2 containing a bobbin is applied to the dummy shaft 6, it can be held by the dummy shaft 6. In this state, a bobbin engaging pawl 2*d* of the bobbin case 2 engages a groove of a rotation-locking member 5*aa* projecting near the dummy shaft 6. Thus, the bobbin case 2 is held while being locked at a predetermined position.

The residual-thread amount detecting device 500 is disposed at the residual thread removing position B. The residual-thread-amount detecting device 500 is used for both removing a residual thread from the bobbin that is taken out of the shuttle and detecting an amount of the residual thread. The residual thread removing device 161 has a gripping means. The gripping means can grip and release the tip of a thread wound around the bobbin shaft, and turned when driven by a residual thread (winding) motor, for example. To remove a residual thread, it is gripped with the gripping means and automatically rolled around the gripping means. The residual thread removing device 161 may also take the following construction. In a state that the bobbin case 2 is held by the bobbin case holding means or that the bobbin case 2 is transferred to a means capable of holding the bobbin case 2 and held by the means, means for pulling out a thread that is wound around the bobbin and derived (hangs down) from the bobbin case is operated to pull a thread out of the bobbin that is turned by the thread pull-out action. In another construction of the residual thread removing device 161, a thread pull-out means is operated to pull a thread out of the bobbin taken out of the bobbin case. Additional residual thread removing devices, available for the residual thread removing device 161, are as disclosed Japanese Patent Application Laid-Open Nos. Hei. 7-80177 and 7-275551, filed by the applicant of the present patent application, and U.S. patent application No. 08/560,307, filed Nov. 17, 1995. Any other suitable residual thread removing means may be used for the residual thread removing device 161, as a matter of course.

Figure 17:
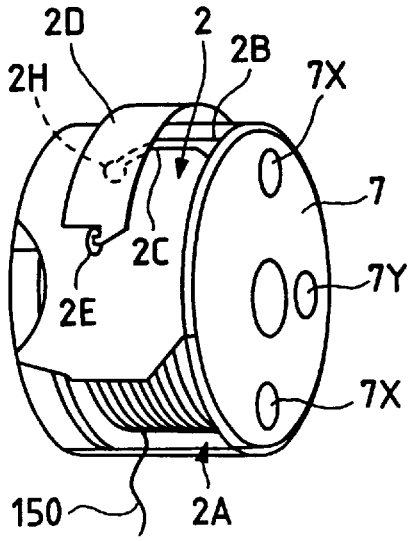
FIG. 17 is a perspective view showing a bobbin case used in the embodiment.

An amount of a residual thread to be pulled out, as shown in FIG. 26, is detected by a residual-thread amount detecting sensor 161*a* including a reflection type photo sensor, for example. The residual-thread amount detecting sensor 161*a* is disposed so as to be confronted with a single reflecting hole 7Y bored in a bobbin flange as shown in FIG. 17, when the bobbin case 2 is set at the residual thread removing position B by the turn of the rotary arm 70. The residual-thread amount detecting sensor 161*a* can detect a rotation of the bobbin caused by the thread pull-out action of the thread pull-out means. An amount of a residual thread is detected by detecting the bobbin rotation at the time of removing the residual thread. The detection of the bobbin rotation enables the machine to judge whether or not the removing operation of the residual thread progresses.

The bobbin thread winding device 162 is disposed at the bobbin thread winding position C. In the present embodiment, the bobbin thread winding device 162 is constructed such that a bobbin is turned by a motor, and a thread is automatically wound around the turning bobbin. As illustrated in a simplified form in FIG. 1, the bobbin thread winding device 162 is made up of a bobbin drive mechanism E, an air guide mechanism G as a thread guide means, and a thread supply detecting mechanism F. The bobbin drive mechanism E will first be described.

Figure 7:
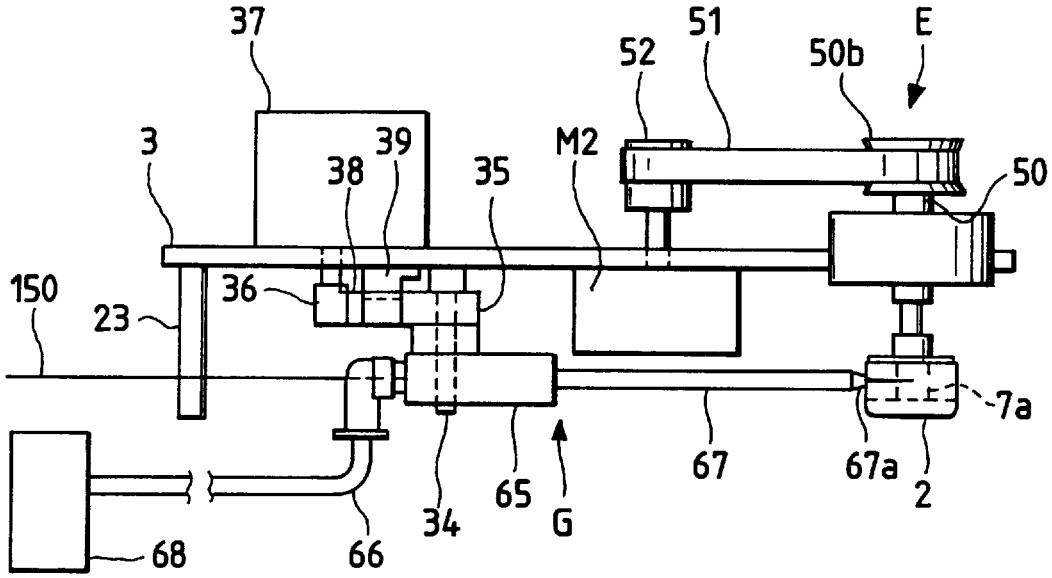
FIG. 7 is a plan view showing a bobbin drive mechanism and an air guide mechanism in a thread winding device used in the automatic bobbin-thread supplying apparatus.
Figure 8:
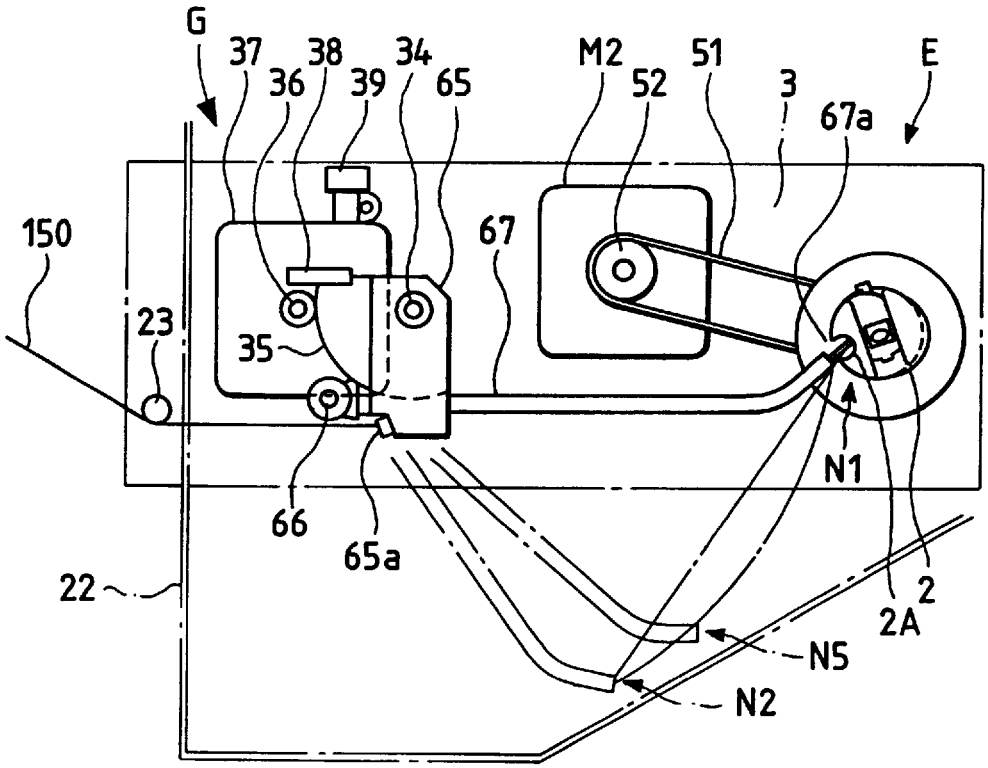
FIG. 8 is a front view showing the bobbin drive mechanism and the air guide mechanism.
Figure 13:
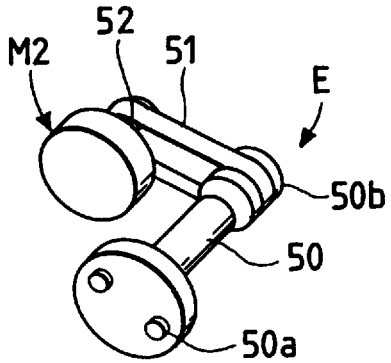
FIG. 13 is a perspective view showing the bobbin drive mechanism.

In FIGS. 7, 8 and 13, reference numeral 50 designates a winding shaft. The winding shaft 50 is rotatably supported by the base plate 3. A clutch mechanism 50*a* that may engage a plural number of holes 7X (FIG. 17) bored in a bobbin 7 is firmly attached to one of the ends of the winding shaft 50. A pulley 50*b* is fixed to the other end of the winding shaft 50. A bobbin drive motor M2 is also mounted on the base plate 3. A pulley 52 is fixed to the output shaft of the bobbin drive motor M2. A belt 51 is stretched between the pulleys 52 and 50*b*.

By a turn of the rotary arm 70, the bobbin case 2 reaches the bobbin thread winding position C. The rotary arm 70 advances, and at this time the bobbin case 2 is slightly advanced. The bobbin drive motor M2 is driven to turn the winding shaft 50. With the turn of the winding shaft 50, the clutch mechanism 50*a* is coupled with the bobbin 7. The clutch mechanism that engages the holes may be substituted by any other suitable clutch mechanism, as a matter of course.

Figure 9:
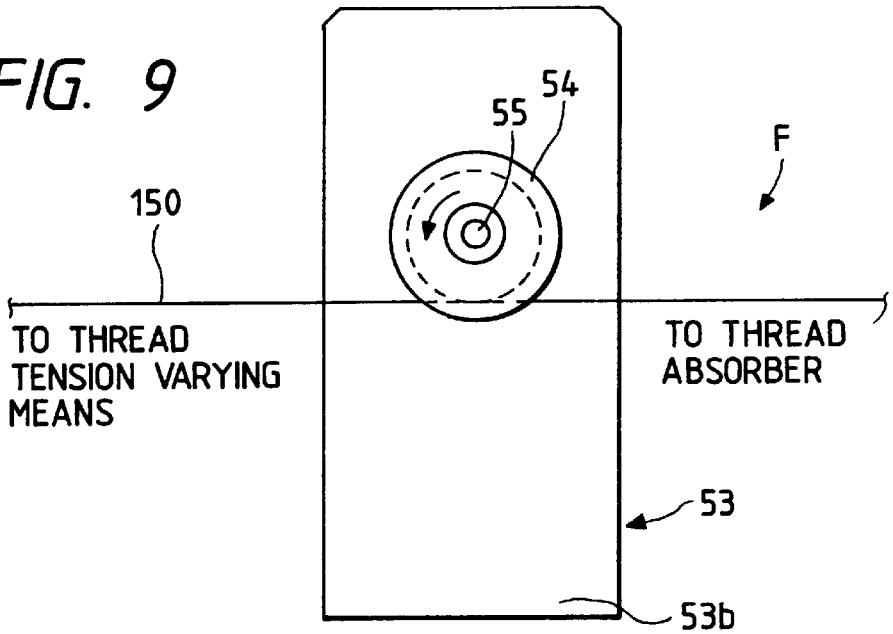
FIG. 9 is a front view showing a thread supplying/detecting mechanism in the bobbin thread winding device.
Figure 10:
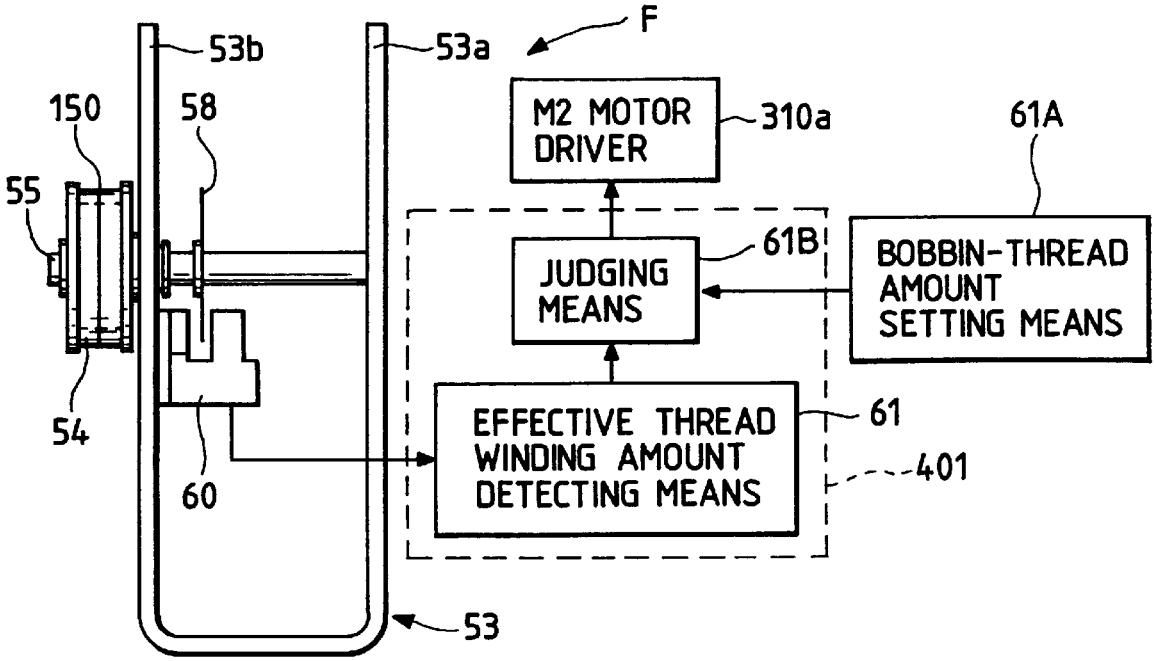
FIG. 10 is a right side view showing the thread supplying/detecting mechanism.

The thread supply detecting mechanism F for detecting the catching of a thread by the bobbin shaft and an amount of thread wound around a bobbin is included in the bobbin thread winding device 162. The thread supply detecting mechanism F will be described hereinafter. Reference is made to FIGS. 9 and 10. Reference numeral 53 designates a base, U-shaped like in cross section, having side plates 53*a* and 53*b*. A roller shaft 55 is bridged between the side plates 53*a* and 53*b*. A roller 54 around which a bobbin thread 150 led from a thread winder 200 is wound by one turn is fixed to the end of the roller shaft 55 protruded outward from the side plate 53*b*.

A sensor slit member 58 is firmly attached to a portion of the roller shaft 55 between the side plates 53*a* and 53*b*. The sensor slit member 58 is shaped like a disc. A slit is formed in the circumferential outer surface of the sensor slit member 58. A photo sensor 60 for sensing the slit of the sensor slit member 58 is located facing the sensor slit member 58. Thus, a rotation of the roller 54 can be detected by the photo sensor 60.

Figure 27:
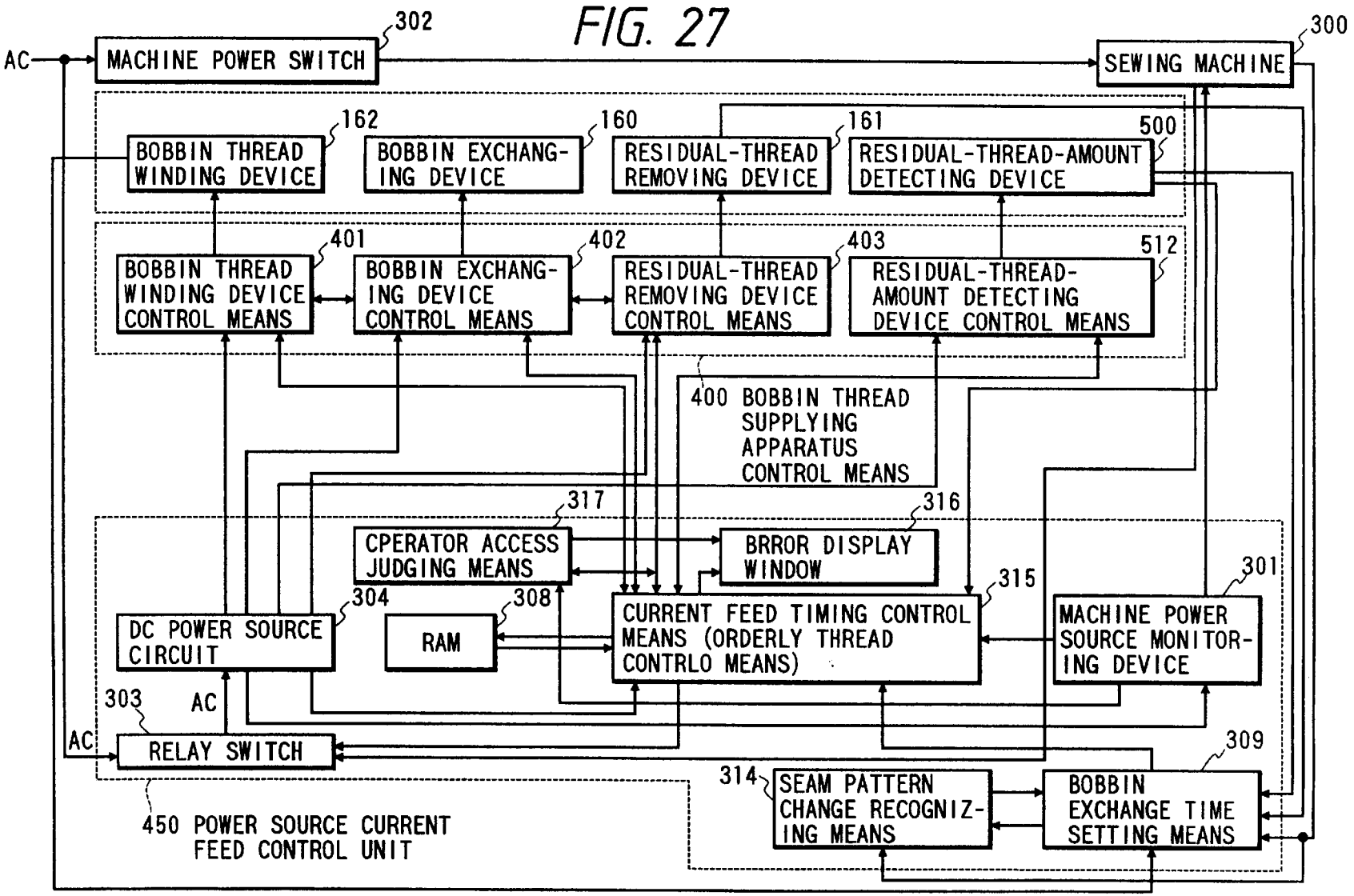
FIG. 27 is a block diagram showing a control system in the automatic bobbin-thread supplying apparatus.

The photo sensor 60 is connected to an effective thread winding amount detecting means 61 which is for detecting the catching of the bobbin thread 150 by the bobbin shaft, and an effective thread winding amount (an amount of bobbin thread wound after the thread is caught by the bobbin shaft) of the thread wound around the bobbin shaft. The effective thread winding amount detecting means 61 is connected to a judging means 61B. The judging means 61B compares a set bobbin-thread winding amount entered by a bobbin-thread amount setting means 61A provided outside the machine with an amount of thread actually wound around the bobbin (indicates an amount of thread winding after the bobbin thread is caught, which is represented by a bobbin thread length into which the number of turns of the roller 54 is converted), and produces a drive stop signal to a driver 310*a* of the bobbin drive motor M2 when both the thread amounts are equal to each other. The effective thread winding amount detecting means 61 and the judging means 61B are incorporated into a BTWA (bobbin-thread winding apparatus) control means 401 (FIG. 27).

The air guide mechanism G is disposed downstream of the thread supply detecting mechanism F. The mechanism G guides a bobbin thread 150 from the thread winder 200 (FIG. 11) as a bobbin thread source into the bobbin case 2 by way of an opening 2A of the bobbin case 2. The air guide mechanism G will be described hereinafter. Reference is made to FIGS. 7, 8 and 12. Reference numeral 65 indicates a thread absorber cylindrical in shape. A through-hole 65*b* serving as a linear path is formed in the thread absorber 65, as shown in FIG. 12. An absorbing hole 65*a* is branched from a mid position of the through-hole 65*b*, and its distal end is opened to outside. An opening at the upstream end of the through-hole 65*b*, as shown in FIGS. 7 and 8, is connected to one end of an air tube 66. The other end of the air tube 66 is connected to an electromagnetic valve 68. The electromagnetic valve 68 is connected to an air source, not shown. An opening at the downstream of the through-hole 65*b* is connected to one end of an air tube 67. The other end portion of the through-hole 65*b* is bent and the other end thereof is provided with an air nozzle 67*a* as a bobbin thread source.

The thread absorber 65 is connected to a nozzle shaft 34, as shown in FIGS. 7 and 8. The nozzle shaft 34 is rotatably supported by the base plate 3. A nozzle gear 35 is secured to a portion of the nozzle shaft 34 between the thread absorber 65 and the base plate 3, and in mesh with a nozzle motor gear 36. The nozzle motor gear 36 is firmly coupled with the output shaft of a stepping motor 37 mounted on the base plate 3.

When the stepping motor 37 is driven, the thread absorber 65, the air tube 67, and the air nozzle 67*a* are pivotally turned about the nozzle shaft 34. At this time, a position of the turning air nozzle 67*a* is detected by a nozzle sensor 39, which is for detecting a position where a sensor plate 38 is mounted on the nozzle gear 35 and a position where the sensor plate 38 is mounted on the base plate 3. The stepping motor 37 is controlled on the basis of the detection result. The air tube 67 is turned when the stepping motor 37 is driven. With the turn of the air tube, the air nozzle 67*a* thereof is moved between a position (work position) N1 facing the opening 2A of the bobbin case 2 (at this time, the air tube 67 is located as indicated by a solid line in FIG. 8), and a retract position N2 angularly spaced from the work position N1 (at this time, the air tube 67 is located as indicated by a one-dot chain line in FIG. 8).

At the work position N1, the air nozzle 67*a* is positioned so as to face the middle of the bobbin shaft 7*a* as shown in FIG. 7. If it is positioned so as to face one end 7*aa* of the bobbin shaft 7*a*, a bobbin flange 7*b* standing erect at the end 7*aa* will prevent the bobbin thread 150 from being caught by the bobbin shaft (FIG. 38(*a*)).

In FIGS. 7 and 8, reference numeral 22 designates a cover covering the bobbin drive mechanism E and the air guide mechanism G; 23, a guide bar for guiding a bobbin thread from the thread supply detecting mechanism F to the absorbing hole 65*a* of the thread absorber 65.

A thread layer forming means 600 (FIG. 1) is made up of the mechanism for angularly moving the air nozzle 67*a* between the work position N1 and the retract position N2, and the mechanism of the bobbin exchanging device 160 which moves the bobbin case 2 along the transferring shaft 4 while gripping the bobbin case 2 contained in the bobbin 7 therein.

In order that the thread is caught by the bobbin shaft 7*a*, a bobbin thread of a predetermined length has been pulled out of the tip of the air nozzle 67*a* located at the work position N1 (to be described in detail later). The length (LL) of the bobbin thread led out of the air nozzle 67*a* is long enough for the bobbin shaft to catch the tip of the thread. The length LL is preferably within a range (1) defined by {(length between the air nozzle located at the work position N1 and the outer surface of the bobbin shaft)+[length of the circumference of the bobbin shaft×(1.1 to 2.0)]}. More preferably, it is selected within a range (2) defined by {(length between the air nozzle located at the work position N1 and the outer surface of the bobbin shaft)+[length of the circumference of the bobbin shaft×(1.25 to 1.8)]}.

If the bobbin thread length is longer than the length range (1), it is difficult to put the end of the thread into the bobbin case 2 through the opening 2A thereof. If it is successfully put into the bobbin case, it will be turned round the bobbin shaft 7*a* by one turn or longer, so that it knots itself to tie the bobbin shaft. If the thread length is shorter than the length ranges (1) and (2), the bobbin shaft possibly fails to catch hold of the end of the bobbin thread.

In the present embodiment, the required bobbin length is determined to be 55 mm. To obtain this figure of the thread length, a distance H between the tip of the air nozzle 67*a* and the opening 2A of the bobbin case 2 was 7 mm, and a distance ranging from the opening 2A to the outer surface of the bobbin shaft was 7 mm, and [25 mm (=circumference length of the bobbin shaft)×1.64 ]=41 mm.

Figure 15:
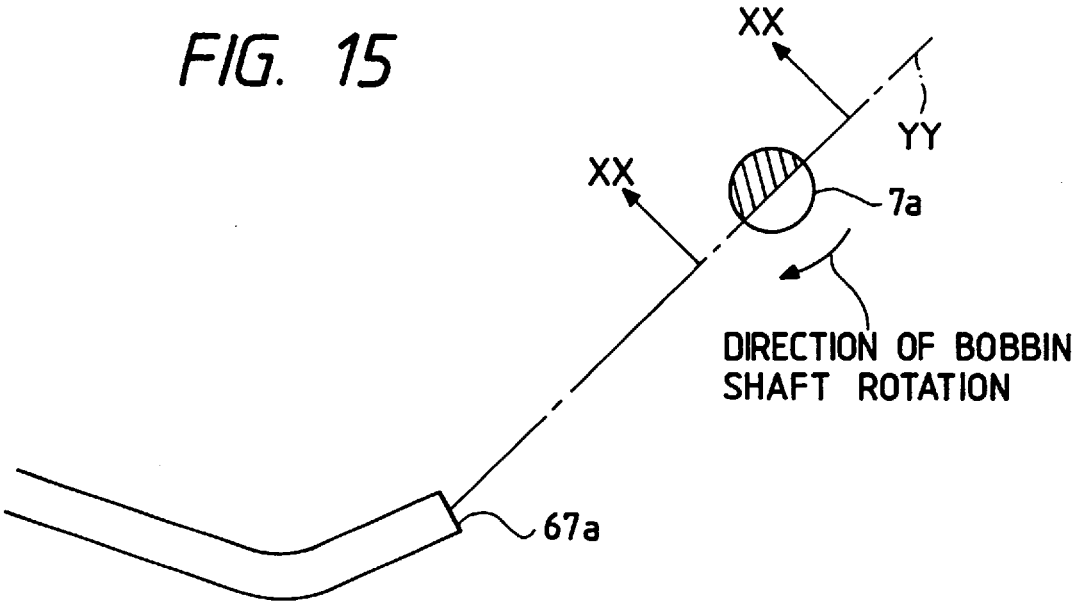
FIG. 15 is an explanatory diagram showing the thread winding side of the bobbin shaft.

The bobbin thread guide direction (air blowing direction) of the tip of the air nozzle 67*a* located at the work position N1 lies in the bobbin thread winding side of the bobbin shaft. Here, the "bobbin thread winding side of the bobbin shaft" means one of the sides of the bobbin shaft 7*a* when the bobbin shaft is axially halved by a line segment YY connecting the center of the bobbin shaft 7*a* to the tip of the bobbin shaft 7*a*, viz., the side of the bobbin shaft (indicated by the direction XX in FIG. 15) which catches the bobbin thread 150. The thread guiding direction of the tip of the air nozzle 67*a* is preferably a direction in which it intersects the outer circumference of the thread winding side XX of the bobbin shaft 7*a*, more preferably a direction tangential to the outer circumference of the thread winding side XX of the bobbin shaft.

The distance H between the tip of the air nozzle 67*a* stopping at a position where it faces the opening 2A (at the work position N1) and the opening 2A of the bobbin case 2 (FIG. 14) is preferably 10 mm or shorter, more preferably 3 to 7 mm. If the distance H is selected within these figures, there is less chance of fluttering of the bobbin thread 150 that is caused by air blowing, and a spiral vortex necessary for the bobbin shaft 7*a* to catch the bobbin thread 150 within the bobbin case 2 can be formed.

Figure 16:
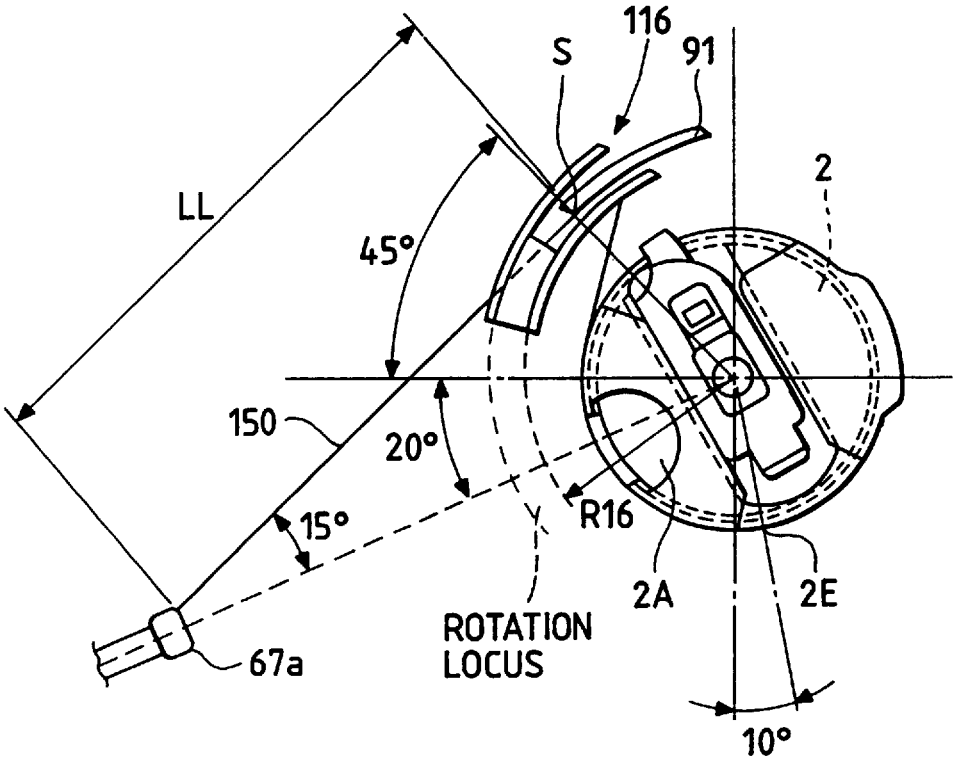
FIG. 16 is an explanatory diagram showing a relative positions of an air nozzle in the air guide mechanism to a thread cutter and a bobbin case when a thread is cut.

In the present embodiment, the bobbin thread winding device 162 additionally includes a thread catching device. As shown in FIG. 16, the thread catching device has a movable knife thread handling member 116 disposed so as to turn around the bobbin case 2 set at the bobbin thread winding position C. By turning the thread handling member 116 around the bobbin case 2, a bobbin thread 150 that is pulled out of the thread winder 200, wound round the bobbin, and led out through the opening 2A, is led to a thread-catching position 2B through a gap between the opening end of the bobbin case 2 and the outer circumference of the bobbin 7, and then to a slit 2C, and finally led out from a location near a hole 2E for a thread tension spring through a thread leading-out hole 2H that is located under a bobbin thread tension spring 2D (FIG. 17). Any type of thread catching device may be used if it can make a bobbin thread 150, which is pulled out of the thread winder 200, wound around the bobbin, and led out through the opening 2A, to the bobbin case 2. Examples of this are as disclosed in Japanese Patent Application Laid-Open No. Hei. 7-68071 and Japanese Patent Application No. Hei. 7-65140 (Japanese Patent Application Laid-Open No. Hei. 8-229262).

The bobbin thread winding device 162 includes a thread cutting device. This device is constructed such that a bobbin thread 150, which is pulled out of the thread winder 200 and led out from a location near the tension-spring hole 2E, is handled through the turning motion of the thread handling member 116, and cut off while the bobbin thread of a predetermined length is left on the bobbin, in cooperation with a fixed knife 91 (FIG. 16).

The bobbin case 2, the fixed knife 91, a bobbin thread cutting point S (more exactly a point where the movable knife thread handling member 116 moves past the fixed knife 91: see FIG. 16), and the like are arranged such that a length of the bobbin thread led out from a location near the tension-spring hole 2E, which ranges from the hole 2E to the bobbin thread cutting point S, is necessary for forming seams by intertwining of the bobbin or bobbin thread with the upper thread; approximately 40 mm.

The bobbin case 2, the bobbin thread cutting point S, a thread-cutting position N5, and the like are arranged such that when the air nozzle 67*a* reaches the thread-cutting position N5 located between the work position N1 and the retract position N2, a distance between the bobbin thread cutting point S and the tip of the air nozzle 67*a* at the time of cutting the thread is approximately equal to the length LL (about 55 mm in the embodiment) necessary for securing the catching of the bobbin thread by the bobbin shaft 7*a* (FIG. 16).

Any type of the thread cutting device may be used if it is capable of cutting off a bobbin thread 150, which is pulled out of the thread winder 200, wound around the bobbin, and led out from a location near the tension-spring hole 2E through the thread leading-out hole 2H that is located under a bobbin thread tension spring 2D, while leaving the bobbin thread of the predetermined length on the bobbin. Examples of this type of thread cutting device are as disclosed in Japanese Patent Application Laid-Open No. Hei. 7-68071 or 8-229262 (Japanese Patent Application No. Hei. 7-65140).

Figure 11:
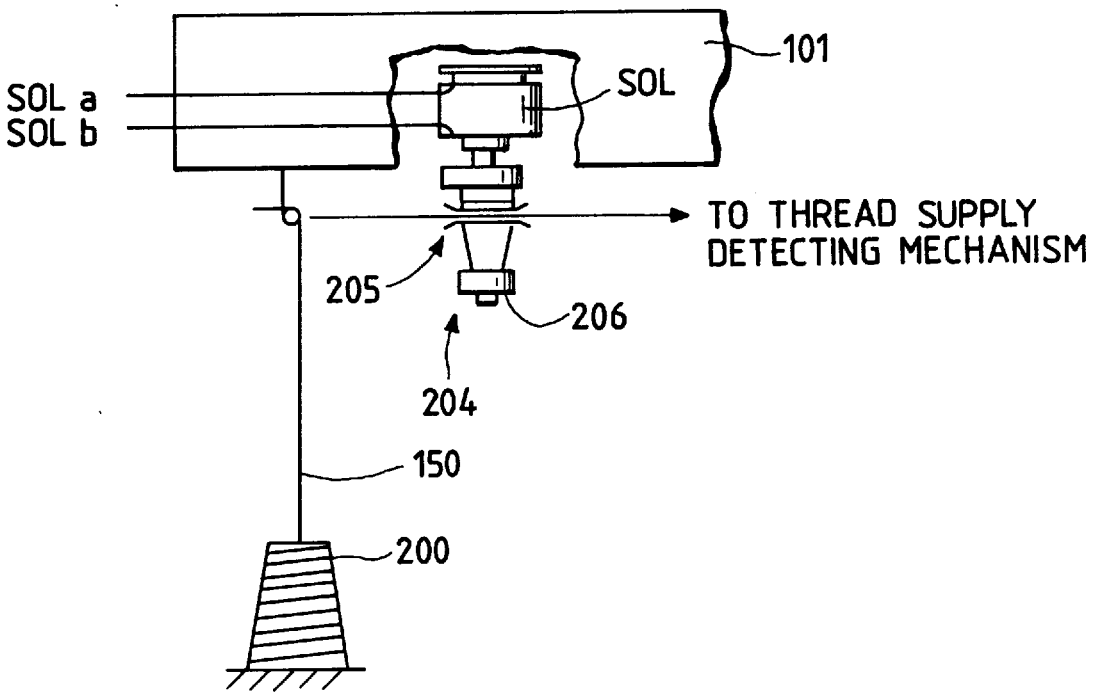
FIG. 11 is a front view showing a thread tension varying means in the bobbin thread winding device.
Figure 12:
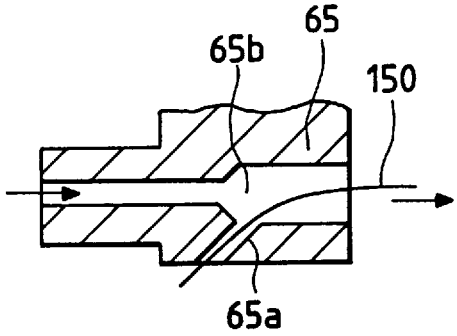
FIG. 12 is a traverse cross section showing the air guide mechanism and a thread absorber.

A tension varying means 204 for varying a tension of the bobbin thread 150 is provided between the thread supply detecting mechanism F and the thread winder 200 (FIG. 11). The tension varying means 204 includes a tension spring 205 for pushing the passing bobbin thread 150, a screw 206 for manually adjusting a pressure force of the tension spring 205, and a solenoid SOL, disposed in the machine bed 101, for producing a solenoid propelling force which resists a pushing force of the tension spring 205. An electric circuit for driving the tension varying means 204 contains a switch inserted in a series connection of the solenoid SOL and an electric power source.

When the switch is turned off, no solenoid propelling force is generated, and a maximum pushing force of the tension spring 205 exerts on the bobbin thread 150, and a tension of the bobbin thread reaches the maximum. When the switch is turned on, the solenoid propelling force is at the maximum, and a difference between a pushing force of the tension spring 205 and a solenoid propelling force exerts on the bobbin thread 150. The result is that the bobbin thread tension decreases to the minimum.

If the residual thread removing device 161 and the bobbin thread winding device 162 come in contact with the base plate 3, the base plate 3 is properly cut out so as to avoid such contact. For ease of explanation, in FIG. 1, the residual thread removing position B, the bobbin thread winding position C and the bobbin case exchanging position D for the dummy shaft 6 are illustrated while being close to one another, and the holder portions 11 are exaggerated. Therefore, one may consider that the holder portions 11 will come in contact with the residual thread removing device 161 and the bobbin thread winding device 162. However, no problem arises since actually, those are sufficiently spaced from one another.

Figure 19A:
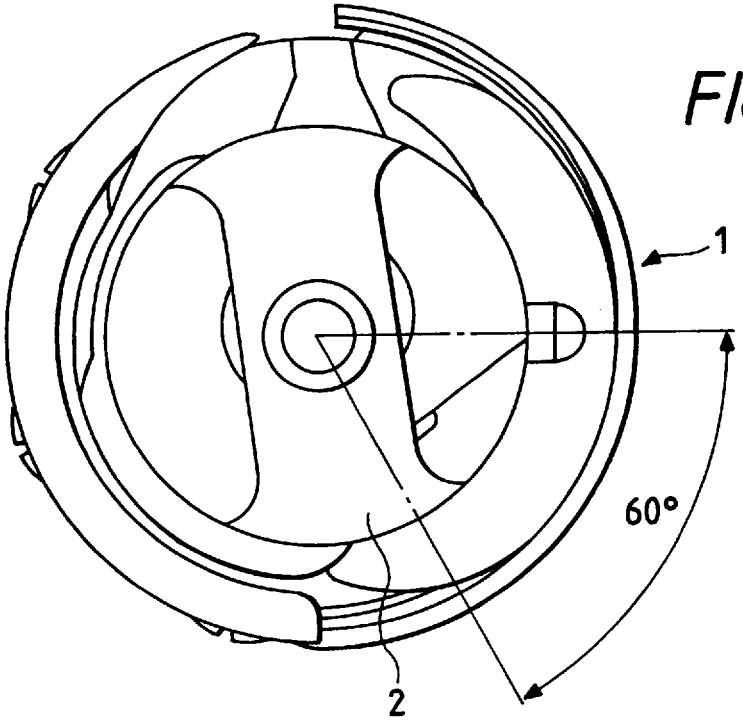
FIGS. 19(*a*) and 19(*b*) show a shuttle with the bobbin case loaded thereinto, and more specifically FIG. 19(*a*) is a front view of the shuttle, and FIG. 19(*b*) is a diagram when viewed in the direction of arrows C—C.
Figure 19B:
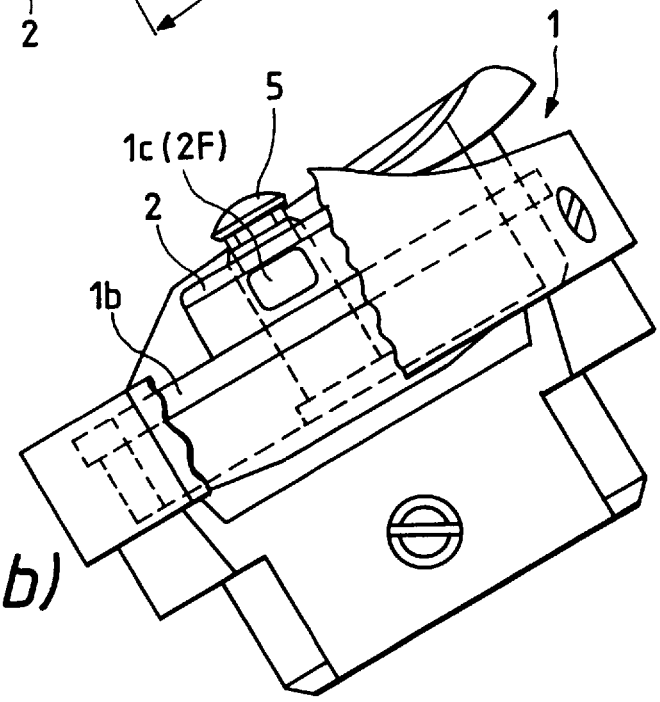

A detecting-bar hole 1*c*, as shown in FIG. 19(*b*), is formed in the shuttle body. A detecting bar 507 of the residual-thread-amount detecting device 500 (to be described in detail later) as disclosed in U.S. patent application No. 08/582,614, may be inserted into the detecting-bar hole 1*c*. The location of the shuttle body where the detecting-bar hole 1*c* is to be formed is a location that is angularly spaced 60° in the clockwise direction from a horizontal plane including the shuttle shaft 1*a* of the shuttle 1 when the shuttle 1 is viewed from the front thereof, where (left upper side in FIG. 19(*b*) is closer to the outside than the race faces of the shuttle body and the shuttle race body (contact surface of the shuttle body and the shuttle race body), and where when the shuttle race body is rotating (when the machine operation is inhibited; when the residual thread amount is detected), the shuttle race body retracts and the shuttle body is exposed.

In the present embodiment, a detecting-bar hole 2F is formed in the peripheral wall of the bobbin case 2. When the shuttle 1 is inserted into the bobbin case 2, the detecting-bar hole 2F is aligned with the detecting-bar hole 1*c* of the shuttle body. The location on the peripheral wall of the bobbin case where the thread supply detecting mechanism F is to be formed is a location where is angularly spaced about 30° apart from the fixed end of the bobbin thread tension spring 2D (FIG. 18(*b*) and which is close to the fixed end of a bobbin case shaft 2G in the bobbin case (FIG. 18(*c*)).

An actuator 501 which constitutes the residual-thread-amount detecting device 500 is fixedly disposed at a location (right lower location under the shuttle 1 in FIG. 1) where is near a location facing the detecting-bar hole 1*c* of the shuttle body. When the bobbin case 2 is set in the shuttle 1 and the detecting bar 507 to be described in detail later is projected forward, the actuator 501 causes the detecting bar 507 to advance into the detecting-bar holes 1*c* and 2F. The actuator 501 will be described hereinafter.

Figure 20A:
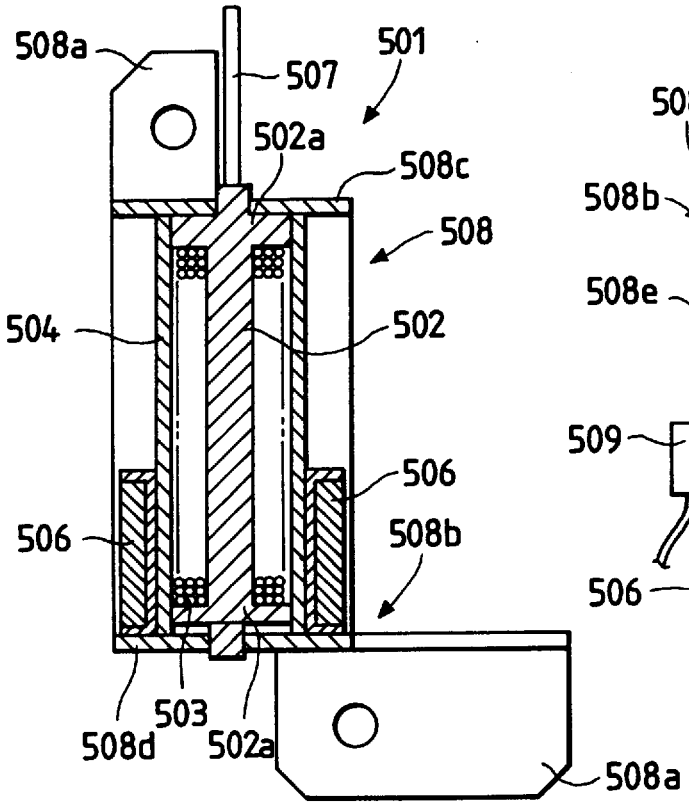
FIGS. 20(*a*) to 20(*c*) show a residual-thread-amount detecting device used in the automatic bobbin-thread supplying apparatus, and more specifically FIG. 20(*a*) is a cross sectional view showing the detecting device when viewed from the front, FIG. 20(*b*) is a cross sectional view of the same when viewed from the right side, and FIG. 20(*c*) is a bottom view of the same.
Figure 20B:
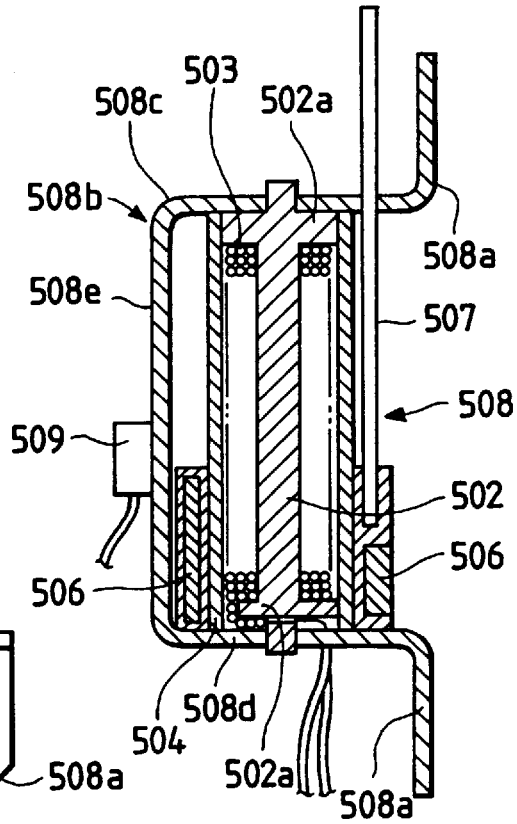
Figure 20C:
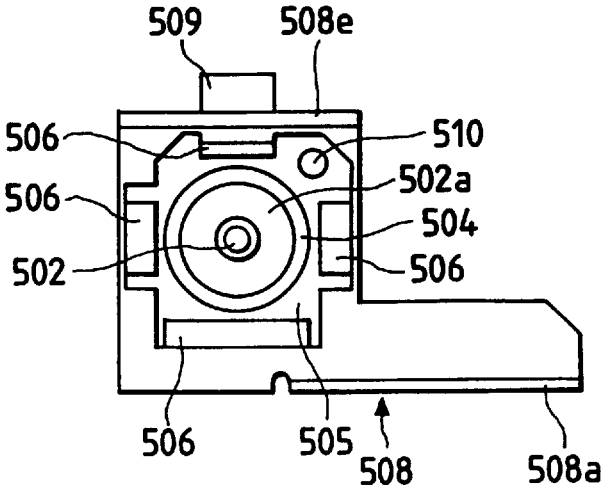

Referring to FIG. 20, a frame 508 is made of nonmagnetic material, for example, stainless steel. The frame 508 includes a frame body 508*b* U-shaped in cross section, and frame bases 508*a* mounted on the U-shaped end faces of the frame body 508*b*. An iron core 502 is bridged between side plates 508*c* and 508*d*. These side plates define the U-shape of the frame body 508*b* and stand erect on the frame bases 508*a*. The iron core 502 is made of a high permeability material, e.g., such as low-carbon steel or electromagnetic soft iron. Disc-like flanges 502*a* form both ends of the iron core 502 located between the side plates 508*c* and 508*d*. A coil 503 is wound round the body of the iron core 502, at high density. A cylindrical sleeve 504 is a bearing member made of plastic, for example, and is fit to the circumferential outer surface of each of the disc-like flanges 502*a*. A carrier 505, substantially parallelepipedic, made of light material, for example, aluminum, is supported on the outer surface of the sleeve 504 in a manner that it is slidable in the axial direction. The carrier 505 is movable between the side plates 508*c* and 508*d*.

Permanent magnets 506 are firmly attached to the respective outer sides of the carrier 505, respectively. The permanent magnets 506 is made of rare-earth magnet, for example, neodymium. These four permanent magnets 506 are all disposed in such that the inner side of each magnet has an N pole while the outer side thereof has an S pole. A detecting bar 507, made of a material belonging to an iron family, is bonded to the carrier 505. The bar 507 is projected toward the shuttle 1 passing through the side plate 508*c*, which is closer to the shuttle 1.

The combination of the detecting bar 507, the carrier 505 and the permanent magnets 506 advances (moves upward in FIG. 20(*a*) when a forward current (current which flows in the counterclockwise direction in FIG. 20(*c*)) is fed to the coil 503. When a reverse current (reverse to the forward current) is fed to the coil, the combination retracts (moves downward in FIG. 20(*a*)). The principle of this will be described later. The detecting bar 507, the carrier 505 and the permanent magnets 506 form a movement member. The iron core 502, coil 503, flanges 502*a*, sleeve 504, and the frame 508 make up a stator.

The actuator 501 is adjusted in position in the following way. When the detecting bar 507 advances and enters the bobbin case 2 through the holes 1*c* and 2F, if no thread is wound on the bobbin or a small amount of the bobbin thread is left on the bobbin and the bobbin must be exchanged with a new one, the carrier 505 runs against the side plate 508*c* (as an engaging member) located closer to the shuttle (FIG. 32(*b*). In this case, if a lower or bobbin thread is sufficiently wound around the bobbin 7, the end of the detecting bar 507 runs against the outer surface of the bobbin thread 150 (as an engaging member), before the carrier 505 runs against the side plate 508*c*.

Returning to FIG. 20, a vibration sensing element, e.g., an ultrasonic wave sensor 509, is bonded on the surface of a coupling plate 508*e*, which defines the U-shape and couples the side plates 508*c* and 508*d* together. The ultrasonic wave sensor 509 senses an ultrasonic wave generated when the carrier 505 hits the side plate 508*c* and the side plate 508*d*, and when the end of the detecting bar 507 hits the outer side of the lower thread wound on the bobbin 7. In FIG. 20(*c*), reference numeral 510 designates a guide shaft 510 which prevents the carrier 505 from turning with respect to the sleeve 504. The guide shaft 510 is made of nonmagnetic material, such as stainless steel.

The residual-thread-amount detecting device 500, as shown in FIG. 26, includes a drive circuit 511 as a current supplying means, which is connected to the coil 503 of the actuator 501. The drive circuit 511 feeds a forward current or a reverse current to the coil 503 in response to a drive current up/down signal and an advance/retract signal (FIG. 25), which are output from a control means 512 for controlling the residual-thread-amount detecting device, which will subsequently be described.

The residual-thread-amount detecting device 500, as shown in FIG. 26, includes a residual-thread-amount judging means 513 connected to the ultrasonic wave sensor 509 of the actuator 501. The residual-thread-amount judging means 513 is used for detecting whether or not a residual thread amount and a movement of the movement member are present. The residual-thread-amount judging means 513 includes a comparator 513*a* which receives at one input terminal a voltage waveform output from the ultrasonic wave sensor 509, and a predetermined reference voltage at the other input terminal, and a one-shot generator circuit 513*b* which receives a pulse signal (trigger signal) output from the comparator 513*a* and outputs a one-shot signal having the pulse width extended to be longer than the pulse width of the trigger signal.

The reference voltage is selected to be between an output signal of a large amplitude, which is output from the ultrasonic wave sensor 509 when the carrier 505 collides with the side plate 508*c* located closer to the shuttle and the side plate 508*d* further from the shuttle, and an output signal of a small amplitude, which is output from the ultrasonic wave sensor 509 when the end of the detecting bar 507 collides with the outer side of the lower thread wound on the bobbin 7.

An operation panel (not shown) is mounted on the automatic bobbin-thread supplying apparatus. The operation panel includes a setting switch (bobbin-thread amount setting means) 61A (FIG. 10), an error display window 316 as display means, and the like. An automatic bobbin-thread supply control unit for controlling the automatic bobbin-thread supplying apparatus will be described hereinafter.

A sewing machine 300 for carrying out a predetermined sewing operation includes a machine power switch 302 for turning on and off a main power source, and a machine power source monitoring means (machine power source monitoring circuit) 301 for judging whether or not the power switch 302 is turned on or off. The machine power source monitoring means 301 forms a part of a power source current-feed control unit 450 (FIG. 27) to be described later. The machine power source monitoring means 301 outputs a signal (referred to as an OFF detect signal) based on the detection of an OFF signal output from the power switch 302, to a current-feed timing control means 315 (to be described later) of the power-source current-feed control unit 450, while monitoring a power source of +5V, for example, in a machine control circuit.

The main power source is also connected to a DC power source circuit 304 through a relay switch 303 which constitutes a control switch means of the power-source current-feed control unit 450 to be described later. The DC power source circuit 304 of the power-source current-feed control unit 450 feeds drive currents to the bobbin thread winding device 162 (including exactly the thread catching device and the thread cutting device), the bobbin exchanging device 160 and the residual-thread-amount detecting device 500 in the automatic bobbin-thread supplying apparatus. The current feeding to those devices 160, 161, 162 and 500 is controlled in accordance with an ON signal and an OFF signal derived from the relay switch 303.

The bobbin thread winding device 162, as shown in FIG. 26, is connected for reception to an M2 motor driver 310*a* for driving the bobbin drive motor M2, an air-nozzle retraction motor driver 310*b* for driving the air-nozzle retraction motor 37, a thread-handling drive motor driver 310*c* for driving the movable knife thread handling member 116, a SOL driver 310*d* for driving the solenoid SOL of the tension varying means 204, and a valve driver 310*e* for driving the electromagnetic valve 68. The bobbin exchanging device 160 is connected for reception to a movement motor driver 311*a* for driving the movement motor 18 and a rotation motor driver 311*b* for driving the rotation motor 20. The residual thread removing device 161 is connected for reception to a motor driver 312*a* for driving the residual thread winding motor. The relay switch 303 is connected for reception to a driver 313.

Signals are applied from a CPU (central processing unit) 306 through an I/O port 305 to the drivers 310*a* to 310*e*, 311*a*, 311*b*, 312*a*, 313, the drive circuit 511, and the one-shot generator circuit 513*b*. The CPU 306 is connected for reception to a ROM 307, and for reception/transmission to a RAM 308. Under control of a bobbin-thread supplying apparatus control means 400, those devices 162, 161, 160 and 500 perform normal operations in the automatic bobbin-thread supplying apparatus, i.e., a known sequence of operations: bobbin exchanging—residual thread removal—bobbin thread winding—thread catching—thread cutting—bobbin exchange request waiting—bobbin exchange request—bobbin exchanging. Further it performs a residual bobbin thread amount detecting operation (FIG. 27). The power source current-feed control unit 450 controls the current feeding to the bobbin-thread supplying apparatus control means 400 so as to enable those devices to perform the above-mentioned operations.

As shown in FIG. 27, the bobbin-thread supplying apparatus control means 400 is made up of the BTWA control means 401, a BED (bobbin exchanging device) control means (bobbin transferring/exchanging device control means) 402, a RTRD (residual thread removing device) control means 403 and a RTADD (residual-thread-amount detecting device) control means 512. The DC power source circuit 304 of the power source current-feed control unit 450 feeds given currents to those control means 401 to 403, and 512. The current-feed timing control means 315 of the power source current-feed control unit 450 applies operation command signals to those control means. The current-feed timing control means 315 always monitors the operations of the bobbin thread winding device 162, the residual thread removing device 161, the bobbin exchanging device 160, and the residual-thread-amount detecting device 500.

The machine power source monitoring means 301 applies an ON or OFF detect signal, which is based on the detection of an ON or OFF signal derived from the machine power switch 302, to the current-feed timing control means 315. When receiving an OFF detect signal of the machine power switch 302, the current-feed timing control means 315 causes the devices, which are operating at the time of interrupting the supply of the power source, to complete the process executing operations. If other processes must be executed before a scheduled bobbin exchanging operation following the completed process executing operations, the current-feed timing control means 315 causes the related devices to complete the necessary process executing operations, and sets up a bobbin exchange wait mode. In other words, the current-feed timing control means 315 causes the related devices to complete the operation of executing all the processes necessary for the bobbin exchange, and then issues operation command signals to the control means 401 to 403, and 512. Those necessary processes for the bobbin exchange are a residual thread removing process, a bobbin thread winding process, a thread winding process, a thread cutting process, a residual thread amount detecting process to be given later, and the like. The operation command signals are used for moving the bobbin case to a retract position (original position) where the bobbin case is confronted with the shuttle 1.

The current-feed timing control means 315 issues another operation command signal to the BED control means 402 when the processes by the devices are completed and a bobbin exchange wait mode is set up. The operation command signal is used for advancing a bobbin case, which has undergone the processes necessary for the bobbin exchange, from the original position to a position where the bobbin case is confronted with the shuttle 1.

When the bobbin case is advanced from the original position to a position where the bobbin case is confronted with the shuttle 1 by the bobbin exchanging device 160, the current-feed timing control means 315 generates a process complete signal to the relay switch 303. The relay switch 303 always receives an AC drive signal, independently of the machine power switch 302. When receiving a process complete signal from the current-feed timing control means 315, the relay switch 303 produces an OFF command signal to the DC power source circuit 304. Upon receipt of the OFF command signal, the DC power source circuit 304 stops the feeding of the drive currents to the control means 401 to 403, and 512, and the devices 160 to 162, and 500.

Thus, the bobbin case having undergone the processes necessary for the bobbin exchange is put at the position where the bobbin case is confronted with the shuttle 1. Therefore, it is difficult for an operator to make an access to the bobbin and the bobbin case which are within the shuttle 1 or the bobbin confronted with the shuttle 1 and the bobbin case which are confronted with the shuttle 1, unless the rotary arm 70 is forcibly turned. In other words, the operator is permitted to make an access to the bobbin and the bobbin case only when the access is necessary.

The process completion signal output from the current-feed timing control means 315 is also to the RAM (nonvolatile memory) 308 as a power interruption storing means. The RAM 308 may be a battery backup RAM, an EEPROM, or the like. Information on a normal power interruption or an abnormal power interruption (e.g., power breakdown) is stored in the RAM 308. The current-feed timing control means 315 constantly refers to and recognizes the normal or abnormal power interruption signal in the RAM 308. The current-feed timing control means 315 generates an initializing signal for transmission to the control means 401 to 403, and 512 on the basis of the recognized normal or abnormal power interruption signal.

The current-feed timing control means 315, coupled with a given display means 316, generates a display command signal to the display means 316 to cause it to display the normal or abnormal power interruption information, which is read out of the RAM 308.

When receiving an re-ON detection signal of the machine power switch 302, the current-feed timing control means 315 generates an operation command signal to the BED control means 402, whereby the BED control means 402 detects the original position at the position where the bobbin case is confronted with the shuttle 1.

The power source current-feed control unit 450 includes an operator-access judging means 317. The operator-access judging means 317 receives a detect signal from the machine power source monitoring means 301, monitors the operation of the bobbin exchanging device 160, receives a re-ON detect signal of the machine power switch 302, and causes the BED control means 402 to detect the original position at the position where the bobbin case is confronted with the shuttle 1. At this time, the operator-access judging means 317 judges as to whether or not the number of steps when the original position is detected is equal to the number of steps when the bobbin case is advanced to the position where the bobbin case is confronted with the shuttle 1. If those numbers of steps are not equal, the operator-access judging means 317 judges that before the machine power switch 302 is turned on again, an operator made an access to the bobbin and the bobbin case which are within the shuttle 1 or the bobbin confronted with the shuttle 1 and the bobbin case which are confronted with the shuttle 1 (in other words, the operator pulled out them and did something on them, although any trouble did not occur).

When the operator makes an access to the bobbin and the bobbin case before the machine power switch 302 is turned on again, the operator-access judging means 317 generates a display command signal representative of the operator's access to the bobbin and the bobbin case, and sends it to the display means 316.

The current-feed timing control means 315 generates an operation command signal to the RTADD control means 512 so that when the number of stitches in an actual sewing operation exceeds a predetermined number of stitches entered in advance by a number-of-stitch input switch (not shown) after the thread is cut, the residual-thread-amount detecting device 500 detects an amount of residual bobbin thread. Here, the predetermined number of stitches entered in advance means an estimated number of stitches required till an object under sewing is replaced with another.

Particularly, the power source current-feed control unit 450 includes a bobbin exchange time setting means 309. The bobbin exchange time setting means 309 sets an optimal bobbin exchange time at which an amount of bobbin thread providing a maximum of sewing is left in the bobbin (i.e., a minimum of unusable thread is left on the bobbin), on the basis of an amount of bobbin thread wound on the bobbin by the bobbin thread winding device 162, an amount of residual bobbin thread detected by the residual-thread amount detecting sensor 161*a*, and the number of thread cutting signals (number of thread cuttings) derived from the sewing machine 300.

The bobbin exchange time setting means 309

1) converts the number of revolutions Rm of the roller 54 in the bobbin thread winding device 162 into an amount of thread Lm (in cm) wound on the bobbin,
2) converts the number of revolutions Rz (in cm) of the bobbin 7 detected by the residual-thread amount detecting sensor 161*a*,
3) calculates a length Ls of the bobbin thread actually used by using $$Ls=(Lm-Lz),$$

4) calculates a length L1 of the bobbin thread consumed by actual sewing by $$L1=(Ls-Lc\times Nc)$$

(where Lc is a length of cut thread (for example, 2 cm), and Nc is the number of thread cuttings), 5) calculates the number of stitches Q2 for 10 cm by using $$Q2=Q1/(L1/10\text{ cm})$$

(where Q1 is the number of stitches in an actual sewing operation), and 6) calculates the number of stitches Q3 that the residual bobbin thread allows, by using $$Q3=(Lz/10\text{ cm})\times Q2.$$

Then, when the number of the thread windings by the bobbin thread winding device 162 is at least six (the total number of the thread windings on both the bobbins is less than six. The reason for this will be described later), the total number of stitchings Q4 for one bobbin is calculated by $$Q4=Q1+Q3,$$

and calculates the number of stitches Q5 for 50 cm, the number of stitches Q6 for 1 m, and the number of stitches Q7 for 5 m by $$Q5=Q2+5$$

$$Q6=Q2+10$$

$$Q7=Q2+50.$$

The bobbin exchange time setting means 309 calculates the number of stitches Q8 for each thread cutting by $$Q8=Q1/Nc.$$

When the number of thread windings by the bobbin thread winding device 162 is less than six (the total number of thread windings on both the bobbins is less than six), the bobbin exchange time holds when the following expressions.

$$\text{When } Q8\geqq Q6;\ Q9+(QB+Q5)>Q4 \quad (1)$$

$$\text{When } Q5\leqq Q8<Q6;\ Q9+(Q8+2)>Q4 \quad (2)$$

$$\text{When } Q8<Q5;\ Q9+(Q8\times 2+Q5)>Q4 \quad (3)$$

where Q9=the number of stitches in the current sewing operation (the number of stitches in real time).

When any of the above expressions (1) to (3) is satisfied, the optimal bobbin exchange time holds.

As seen from the expressions, the optimal bobbin exchange time at which the residual bobbin thread provides a maximum of sewing is set in a state that a length of the bobbin thread corresponding to at least the number of stitches Q8 for each thread cutting (or the number of stitches of one seam pattern) is left on the bobbin.

When the thread winding by the bobbin thread winding device 162 is carried out six times or more (the total number of thread windings on both the bobbins is six, or three or more thread windings on each bobbin are carried out), it is judged that the total number of stitches for each bobbin which allows such an amount of bobbin thread in the bobbin to be used for the sewing as to provide a maximum of sewing is settled down.

The total number of actual stitches Q4 for each bobbin is defined as follows:

A) When $Q8 \geqq Q6$:

$$Q4 \leftarrow (Q4-Q2) \text{ for } Q3 \geqq Q8 \quad (8)$$

$$Q4 \leftarrow (Q4+Q2) \text{ for } Q8 < Q3 \leqq Q8+Q5 \quad (9)$$

$$Q4 \leftarrow Q4 \text{ (Q4 remains unchanged) for } Q8+Q5 < Q3 \quad (10)$$

(B) When $Q5 \leqq Q8 < Q6$:

$$Q4 \leftarrow (Q4-Q2) \text{ for } Q3 \leqq Q8 \quad (11)$$

$$Q4 \leftarrow (Q4+Q2) \text{ for } Q8 < Q3 \leqq Q8 \times 2 \quad (12)$$

$$Q4 \leftarrow Q4 \text{ (Q4 remains unchanged) for } Q8 \times 2 < Q3 \quad (13)$$

C) When $Q8 < Q5$:

$$Q4 \leftarrow (Q4 \leqq Q2) \text{ for } Q3 < Q8 \times 2 \quad (14)$$

$$Q4 \leftarrow (Q4+Q2) \text{ for } Q8 \times 2 < Q3 \leqq Q8 \times 2 + Q5 \quad (15)$$

$$Q4 \leftarrow Q4 \text{ (Q4 remains unchanged) for } Q8 \times 2 + Q5 < Q3 \quad (16)$$

When the number of real time stitchings satisfies any of the equations (8) to (16), the optimal bobbin exchange time holds. The reason for this is that after the thread is left two times on each bobbin (when the thread winding is carried out six times or more by the bobbin thread winding device 162), Q4 has reached the total number of stitches allowed for the bobbins.

It is evident that the Q2 to Q8 are calculated in the following way since the bobbins are not uniform in their dimensions, for example, the bobbin shaft diameters are not uniform. The optimal bobbin exchange times are calculated for each bobbin and the results are stored. For judging the optimal bobbin exchange time, the corresponding data is used.

The bobbin exchange time setting means 309 has also the following functions. After a bobbin having a predetermined amount of bobbin thread wound therearound by the bobbin thread winding device 162 is used for sewing, the bobbin is taken out of the shuttle 1, and a residual thread is removed from the bobbin by the residual thread removing device 161. Then, the bobbin exchange time setting means 309 sets an optimal time to exchange the bobbin with a new one. Then, a bobbin thread is wound around the bobbin by the bobbin thread winding device 162, and the bobbin is used again for sewing. Then, the bobbin exchange time setting means 309 evaluates the optimal bobbin exchange time.

In the present embodiment, two bobbins are alternately used in succession for sewing. Then, when the thread winding is carried out at least two times by the bobbin thread winding device 162, the optimal bobbin exchange time is set. When the thread winding is carried out at least three times, the optimal bobbin exchange time is judged. The reason for this follows. The bobbins are both wound by bobbin threads by means of the bobbin thread winding device 162 (the thread windings by the bobbin thread winding device 162 are carried out two times). After those bobbins are used for sewing, a residual thread in one of the bobbins is detected by residual-thread amount detecting sensor 161*a*. The optimal bobbin exchange time is set on the basis of the detected residual thread amount, an amount of the thread wound around the bobbin by the bobbin thread winding device 162, and the number of thread cuttings when the bobbin was for sewing. The bobbin is wound by a bobbin thread by means of the bobbin thread winding device 162 (the third thread winding on the bobbin is carried out), and is used for sewing. The bobbin must be judged on the optimal bobbin exchange time.

When a single bobbin is used and a bobbin thread is wound at least one time by the bobbin thread winding device 162, the optimal bobbin exchange time is set. When the thread winding is carried out at least two times, the optimal bobbin exchange time is judged. When three bobbins are used and the thread is wound at least three times, the optimal bobbin exchange time is set. When the thread winding is carried out at least four times, the optimal bobbin exchange time is judged. As a generalization, when the number of bobbins used is NX and a bobbin thread is wound at least NX times, the optimal bobbin exchange time is set. When the thread winding is carried out at least (NX+1) times, the optimal bobbin exchange time is judged.

The judgement as to whether or not the set bobbin exchange time is reached is made after the residual-thread-amount detecting device 500 performs a residual thread amount and produces a no thread signal for a bobbin exchange request. If the bobbin exchange time is reached, the bobbin exchange time setting means 309 produces a bobbin exchange signal for transmission to the current-feed timing control means 315. Upon receipt of the bobbin exchange signal, the current-feed timing control means 315 generates operation command signals to the control means 401 to 403. In response to the command signals, the sequence of operations are performed: bobbin exchanging operation, and subsequent operations of removing a residual thread from the taken-out bobbin, winding a new thread on the bobbin, thread catching, and thread cutting.

The setting and judging of the bobbin exchange time are invalid for those bobbins on which a thread is wound manually or by an unknown winder. For this type of bobbin, the following operation is performed until the number of thread windings reaches the above-mentioned set times of thread windings. After the residual-thread-amount detecting device 500 generates a no thread signal for a bobbin exchange request through its residual thread amount detecting operation, the current-feed timing control means 315 generates to the control means 401 to 403 operation command signals for causing the sequence of operations comprising bobbin exchanging operation, and subsequent operations of removing a residual thread from the taken-out bobbin, winding a new thread on the bobbin, thread catching, and thread cutting.

When the thread winding by the bobbin thread winding device 162 is performed six times or larger, the current-feed timing control means 315 judges that the total number of stitches for each bobbin which allows such an amount of thread in the bobbin to be used for sewing as to provide a maximum of sewing is settled down. And it judges that the bobbin exchange time is reached on the basis of the total number of stitches for each bobbin by using the expressions (8) to (16), and that the residual thread amount detection by the residual-thread-amount detecting device 500 is not needed, and applies a non-operation command signal for prohibiting that detection to the RTADD control means 512.

The bobbin exchange time setting means 309 is connected to a seam-pattern change recognizing means 314 which recognizes a change of a seam pattern. The seam-pattern change recognizing means 314 recognizes a change of a seam pattern by using the following expressions.

$$Q9+Q5 \geqq Q4 \quad (4)$$

$$Q9+Q7 \geqq Q4 \quad (5)$$

The expression (4) describes that the seam pitch is reduced, and the expression (5) describes that it is increased.

$$Nc-15times \geqq Ncc \quad (6)$$

$$Nc+15times \leqq Ncc \quad (7)$$

where Nc : number of previous thread cuttings

Ncc : number of present thread cuttings (number of real time thread cuttings).

When the expressions (6) and (7) hold, the seam-pattern change recognizing means 314 recognizes that an object under sewing is changed to another. When the above expressions are satisfied, the seam-pattern change recognizing means 314 recognizes that a seam pattern has been changed to another. The settings of the expressions (4)–(7) are made simultaneously with the setting of the bobbin exchange time made by the bobbin exchange time setting means 309.

The seam-pattern change recognizing means 314 recognizes a change of the seam pattern before the bobbin exchange time setting means 309 judges as to whether or not the set bobbin exchange time is reached after the residual-thread-amount detecting device 500 generates a no thread signal for bobbin exchange request through its residual thread amount detecting operation, and only when the residual-thread-amount detecting device 500 first issues a bobbin exchange request to one bobbin. When recognizing a change of a seam pattern, the seam-pattern change recognizing means 314 produces to the bobbin exchange time setting means 309 a signal to direct it to set the bobbin exchange time again. As a matter of course, the seam-pattern change recognizing means 314 sets the expressions (4) to (7) again. When a change of a seam pattern is not recognized, the seam-pattern change recognizing means 314 produces to the bobbin exchange time setting means 309 a signal to direct it to judge as to whether or not the set bobbin exchange time is reached. The recognition of the seam pattern change is permitted only when a thread is wound three to five times by the bobbin thread winding device 162.

When during the residual thread detecting operation, the current-feed timing control means 315 receives a signal indicating that something is wrong with the residual-thread-amount detecting device 500 from the one-shot generator circuit 513*b*, the timing control means 315 produces a display command signal indicating that the residual-thread-amount detecting device 500 is abnormal to the display means 316.

When the device 500 abnormal display, the operator's access display, and the abnormal display on the preceding power interruption are all not present when the machine power switch 302 is turned on again, the current-feed timing control means 315 produces an operation command signal indicative of continuing a given process to the control means 401 to 403, and 512.

When one of the device 500 abnormal display, the operator's access display, and the abnormal display on the preceding power interruption is present when the machine power switch 302 is turned on again, an operator checks a bobbin to be used according to an alarm indication, removes a residual thread from the bobbin, and sets the bobbin cases containing the empty bobbins therein to the dummy shaft 6 in succession.

Then, the current-feed timing control means 315 produces operation command signals to the control means 401 and 402. By the operation command signals, the bobbin cases that are successively set to the dummy shaft 6 by the operator are subjected to the thread winding, thread catching, and thread cutting processes, and one of those bobbins thus processed are set in the shuttle, and the other is held with the bobbin case holding means, whereby a waiting mode is set up.

The current-feed timing control means 315 produces operation command signals to the BTWA control means 401. By the operation command signals, the air nozzle 67*a* is put at the retract position N2 at the time of thread catching and waiting, and put at a thread-cutting position N5 (located between the work position N1 and the retract position N2) at the time of thread cutting operation.

The current-feed timing control means 315 contains an orderly thread winding control means which controls the thread layer forming means 600 so as to orderly wind a thread on the bobbin shaft 7*a*. The orderly thread winding control means issues an operation command signal to the BTWA control means 401. By the operation command signal, the air nozzle 67*a* is first positioned when the bobbin shaft 7*a* catches a thread supplied thereto. At this time, when the effective thread winding amount detecting means 61 produces an output signal indicating that the thread is caught (the output signal is generated when the air nozzle 67*a* is confronted with the end 7*aa* of the bobbin shaft 7*a* closer to the bobbin case holding means, and will be described in detail later), the bobbin shaft 7*a* is put at the retract position N2, whereby the thread winding is performed.

After the air nozzle 67*a* is put at the work position N1, the orderly thread winding control means of the current-feed timing control means 315 receives an output signal indicating that the thread is caught from the effective thread winding amount detecting means 61, and then produces to the BED control means 402 a command signal to slightly advance the bobbin case holding means (moves it to the left in FIG. 37) so that the air nozzle 67*a* is confronted with the end 7*aa* (the right end in FIG. 37) of the bobbin shaft 7*a* closer to the bobbin case holding means.

The orderly thread winding control means of the current-feed timing control means 315 produces an operation command signal for transmission to the BED control means 402. The operation command signal contains such information to slightly move the bobbin case holding means back to its original position so that the air nozzle 67*a* faces the middle of the bobbin shaft 7*a*, when the bobbin shaft 7*a* reaches a thread winding start position where the bobbin shaft 7*a* is confronted with the end 7*aa* of the bobbin shaft 7*a* closer to the bobbin case holding means.

An operation of the automatic bobbin-thread supplying apparatus using such control means will be described with reference to the flow charts shown in FIGS. 28 and 29. For ease of understanding, the operation description will be started at a sewing operation start point. In a step S5, the RAM (nonvolatile memory) 308 is cleared, and then the automatic bobbin-thread supplying apparatus is ready for its operation. In a step S6, the operation of the sewing machine is permitted, and a step S7 is executed. In this step, control judges as to whether or not a thread is cut. If it is cut, a step S8 is executed. In the step S8, control judges whether or not the number of stitches in an actual sewing operation exceeds a predetermined number of stitches input in advance. If it exceeds the predetermined number of stitches, a work under sewing must be replaced with a new one, and a sufficient amount of residual thread is needed. Therefore, a residual thread amount detecting process is carried out in a step S9 and the subsequent ones.

Figure 25:
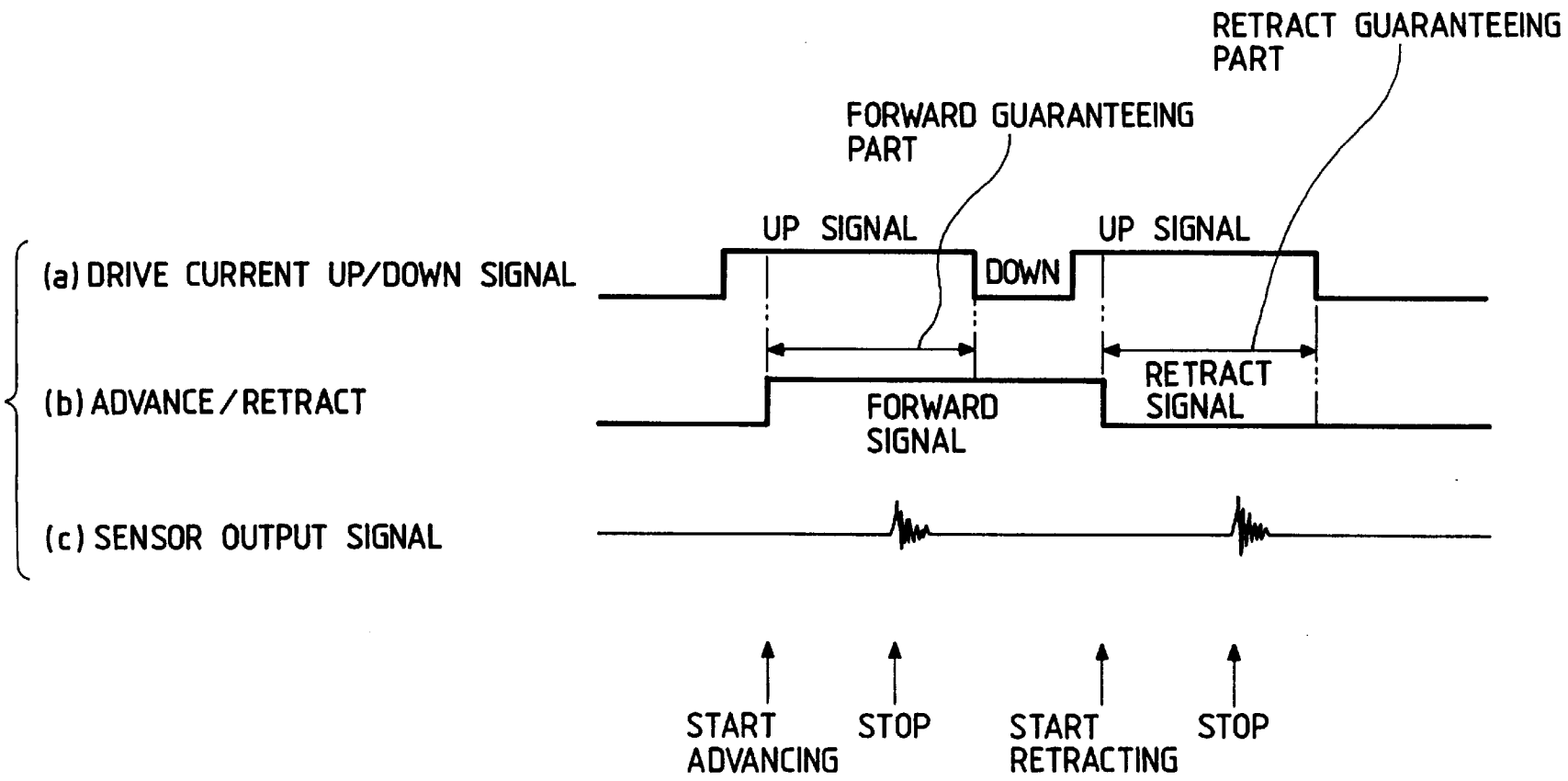
FIG. 25 is a timing chart useful in explaining an operation of the residual-thread-amount detecting device.
Figure 30:
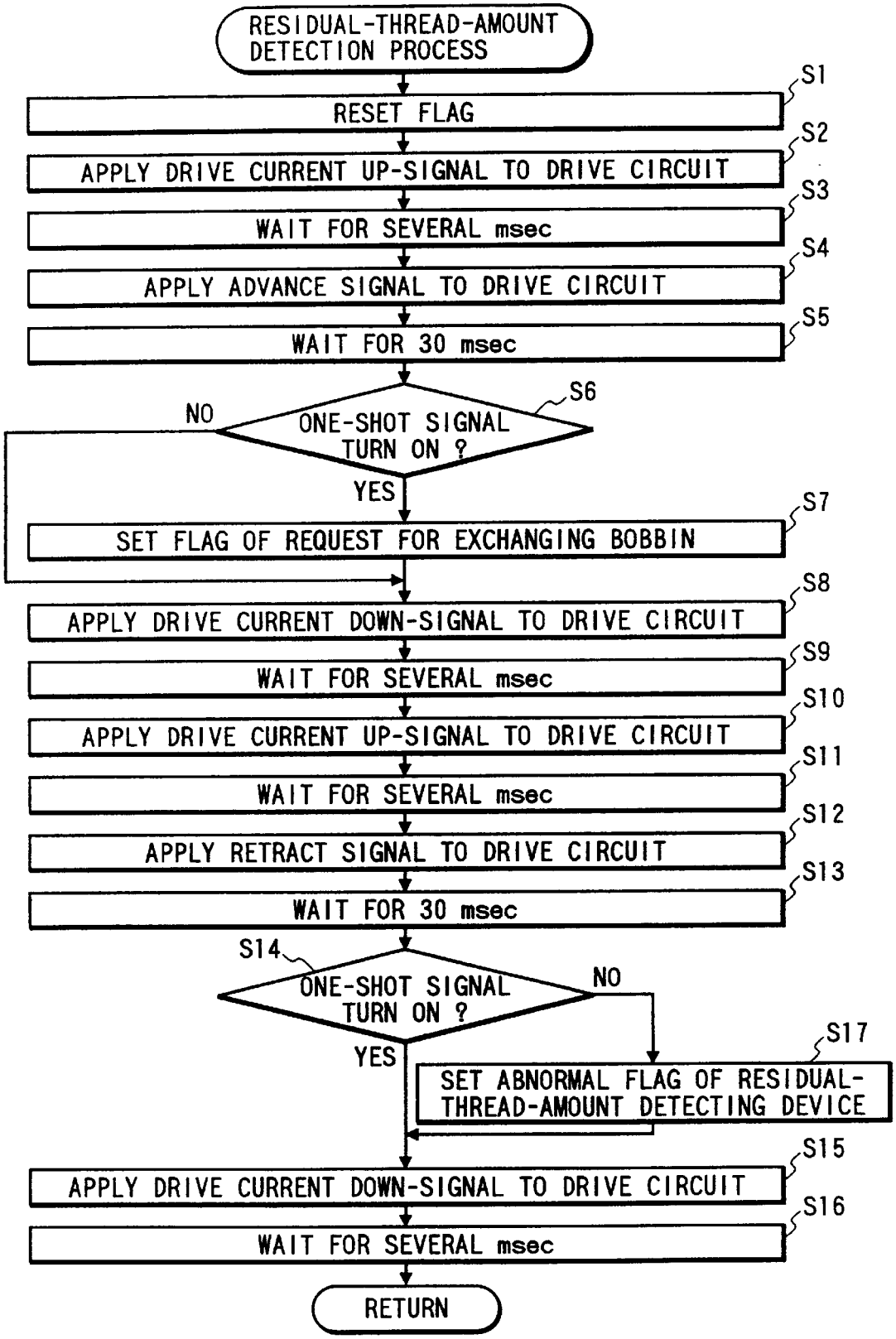
FIG. 30 is a flow chart showing a control flow in the residual-thread-amount detecting device.
Figure 31:
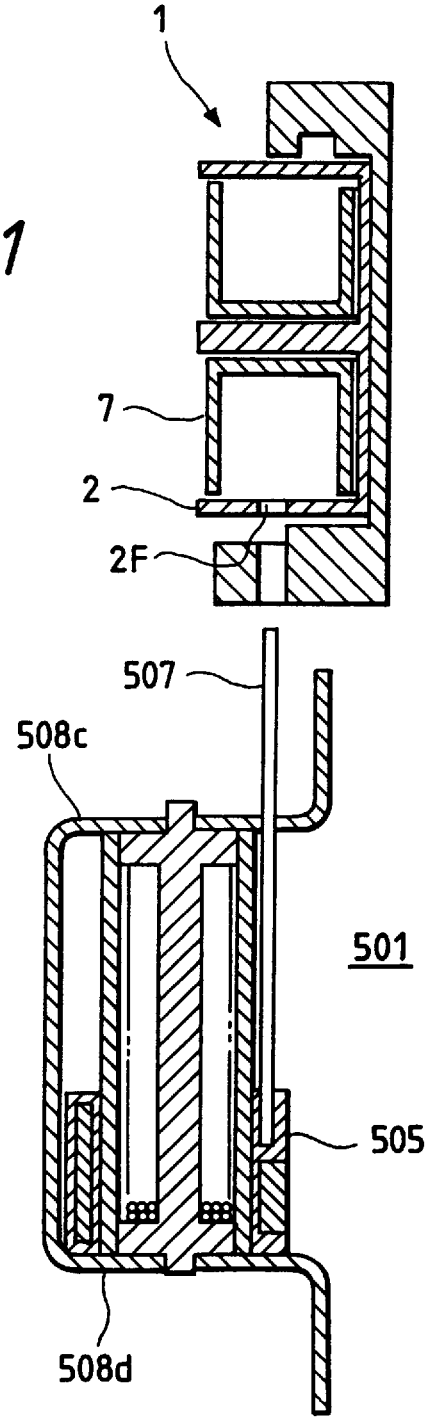
FIG. 31 is a cross sectional view showing a waiting state of the residual-thread-amount detecting device, together with a shuttle with a bobbin case loaded thereinto.

In the step S9, the machine operation is prohibited in order to avoid its interference with the sewing machine, and a step S9*a* is executed. In this step, control judges whether or not a thread is wound at least six times by the bobbin thread winding device 162. The reason why this number is used is as described above. If the thread is wound at least six times, control judges the bobbin exchange time on the basis of the number of stitches (since the total number of stitches for each bobbin which allows such an amount of thread in the bobbin to be used for sewing as to provide a maximum of sewing down is settled down). Accordingly, control judges that the residual thread amount detection by the residual-thread-amount detecting device 500 is not needed. Control skips over steps S10 to S17 to a step S18. If control judges that the thread is wound six times or less, control advances to the step S10. In this step, a residual thread amount detection process is carried out. This process will be described with reference to FIG. 30 showing a subroutine of the residual thread amount detection process. Now, the residual-thread-amount detecting device 500 is in a waiting state as shown in FIG. 31. Specifically, the carrier 505 constituting the actuator 501, as shown in FIG. 31, is abutted against the side plate 508*d* closer to the shuttle. In a step S1, control resets a flag and advances to a step S2 where a drive current UP signal is applied to the drive circuit 511 (FIG. 25(*a*)). Then, a step S3 is executed. In this step, control waits for several milliseconds (msec), and advances to a step S4 where an advancing signal is applied to the drive circuit 511 (FIG. 25(*b*)). In the next step S5, control waits for a preset time, e.g., 30 msec (after 30 msec the drive current becomes a DOWN signal in a step S8 to be given later). Then, a part where the drive current UP signal and the forward signal serves as a forward guaranteeing part (FIG. 25). This part guarantees the supply of a forward current from the drive circuit 511 to the coil 503.

Figure 21A:
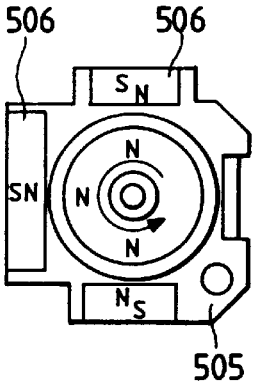
FIGS. 21(*a*) and 21(*b*) show diagrams for explaining the operation of the residual-thread-amount detecting device, and FIG. 21(*a*) corresponds to FIG. 20(*c*), and FIG. 21(*b*) corresponds to FIG. 20(*a*).
Figure 21B:
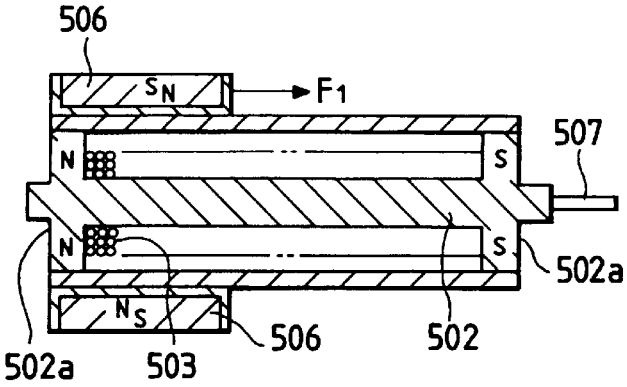
Figure 22A:
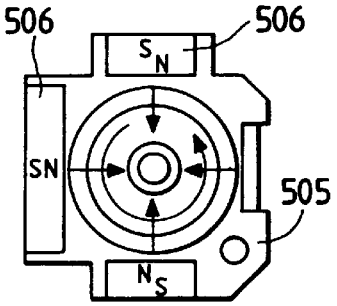
FIGS. 22(*a*) and 22(*b*) show diagrams for explaining the operation following the operation of FIGS. 21(*a*) and 21(*b*), and FIG. 22(*a*) corresponds to FIG. 20(*c*), and FIG. 22(*b*) corresponds to FIG. 20(*a*).
Figure 22B:
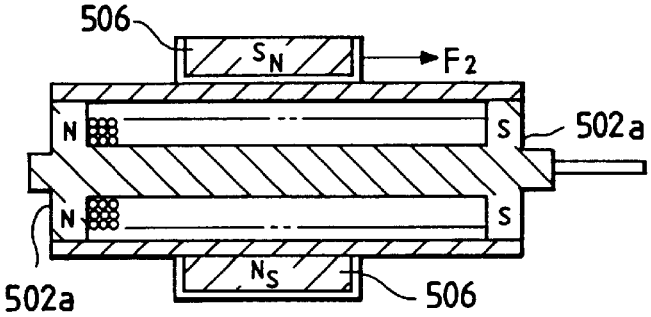

When the forward current (a counterclockwise current in FIG. 20(*c*), and FIGS. 21(*a*) to 24(*a*)) is fed to the coil 503, the iron core 502 serves as an electromagnet, so that the flange 502*a* located farther from the shuttle serves as an N pole while the flange 502*b* closer to the shuttle serves as an S pole. At this time, the surface of the permanent magnet 506 that faces the flanges 502*a*, as shown in FIG. 25(*b*) is N in pole. A repulsion force f1 between the N poles is exerted on the carrier 505. At this time, the coil current interacts with the permanent magnet 506 to generate an electromagnetic force according to Fleming's left hand law, viz., an electromagnetic force causing the coil 503 to move to the left in FIG. 21(*b*). However, the coil 503 is fixed. As a reaction to this, a propelling force f2 which is equal in magnitude to the electromagnetic force but opposite in direction to the same is exerted on the carrier 505. As a result, the carrier 505 receives the resultant propelling force F1 of the propelling force f1 by the magnet of the iron core 502 and the propelling force f2 by the electromagnetic force, and starts to move toward the shuttle (to the right in FIG. 21(*b*)).

The carrier 505 moves to the shuttle, while becoming more distant from the flanges 502*a* (i.e., closer to the shuttle). Accordingly, the propelling force fl by the magnet action becomes gradually small, but the carrier 505 receives the electromagnetic force over a broader area and the propelling force f2 by the electromagnetic force becomes large. The carrier 505 continues its movement toward the shuttle since the resultant propelling force still acts on the carrier.

The carrier 505 reaches a middle point between the flanges 502*a* and 502*b*, or a point substantially equally distanced from the flanges. At this point, the distance of the carrier 505 from the flanges 502*a* and 502*b* is great, and the propelling force f1 by the electromagnetic force, has less effect on the carrier 505. However, the area of the carrier 505 where it receives the electromagnetic force is broad as in the stage described above, and the propelling force f2 acts on the carrier 505. The carrier 505 continues its movement to the shuttle since it receives the resultant propelling force F2.

Figure 23A:
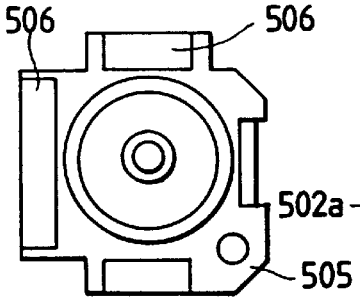
FIGS. 23(*a*) and 23(*b*) show diagrams for explaining the operation following the operation of FIGS. 22(*a*) and 22(*b*), and FIG. 23(*a*) corresponds to FIG. 20(*c*), and FIG. 23(*b*) corresponds to FIG. 20(*a*).
Figure 23B:
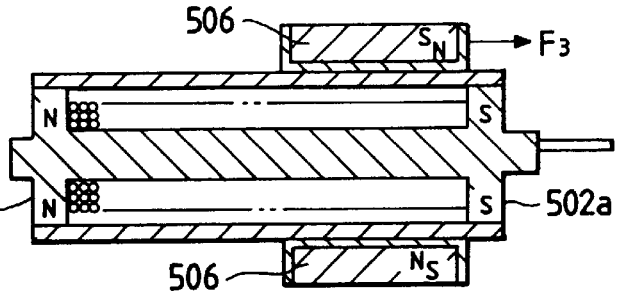
Figure 24A:
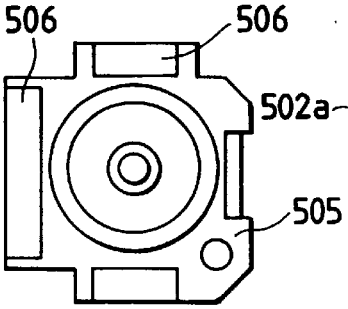
FIGS. 24(*a*) and 24(*b*) show diagrams for explaining the operation following the operation of FIGS. 23(*a*) and 23(*b*), and FIG. 24(*a*) corresponds to FIG. 20(*c*), and FIG. 24(*b*) corresponds to FIG. 20(*a*).
Figure 24B:
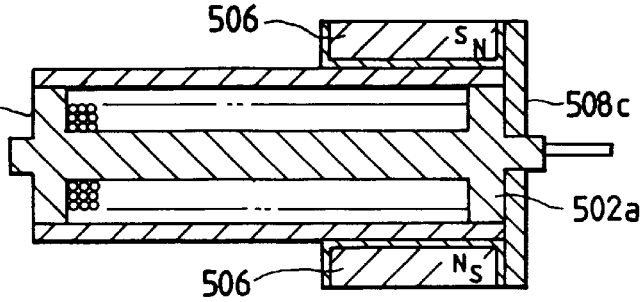

As the carrier 505 moves to the shuttle, it approaches to the flange 502*a* closer to the shuttle, as shown in FIG. 23(*b*). The N pole of the permanent magnet 506 of the carrier 505 is attracted to the S pole of the flange 502*a*. The propelling force fl by the magnet action received by the carrier gradually grows. An area of the carrier 505 where it receives the electromagnetic force is broad as in the stage described above, and the propelling force f2 acts on the carrier. Under the resultant propelling force F3, the carrier 505 continues its movement toward the shuttle.

Figure 32A:
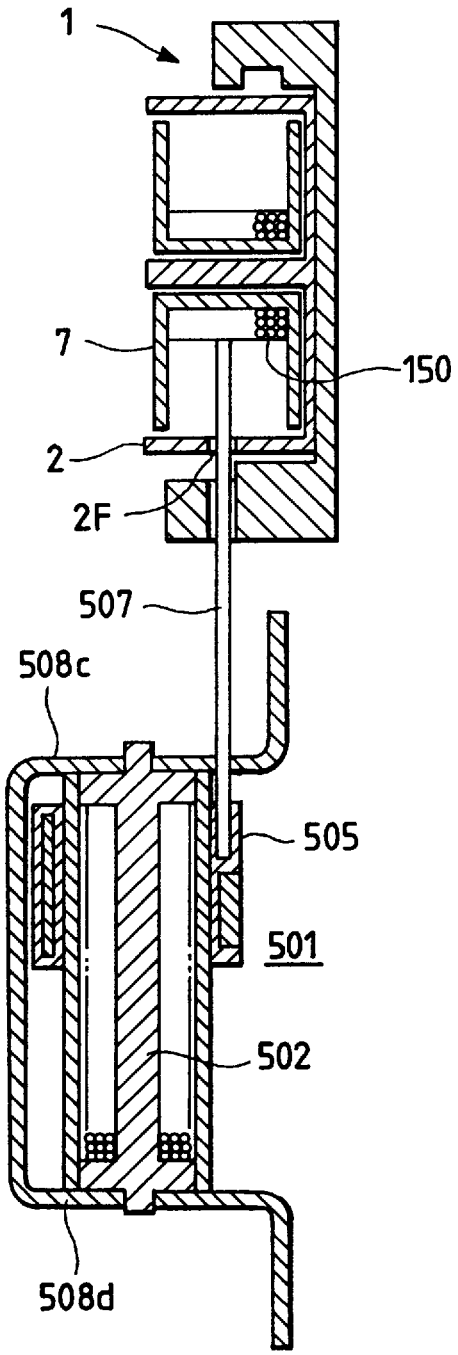
FIGS. 32(*a*) and 32(*b*) are cross sectional views showing a detecting state of the residual-thread-amount detecting device, together with a shuttle with a bobbin case loaded thereinto, and more specifically FIG. 32(*a*) is a cross sectional view showing a detecting state of the detecting device when a small amount of thread is left, and FIG. 32(*b*) is a cross sectional view showing a detecting state of the detecting device when a small amount of thread is left or it is used up.
Figure 32B:
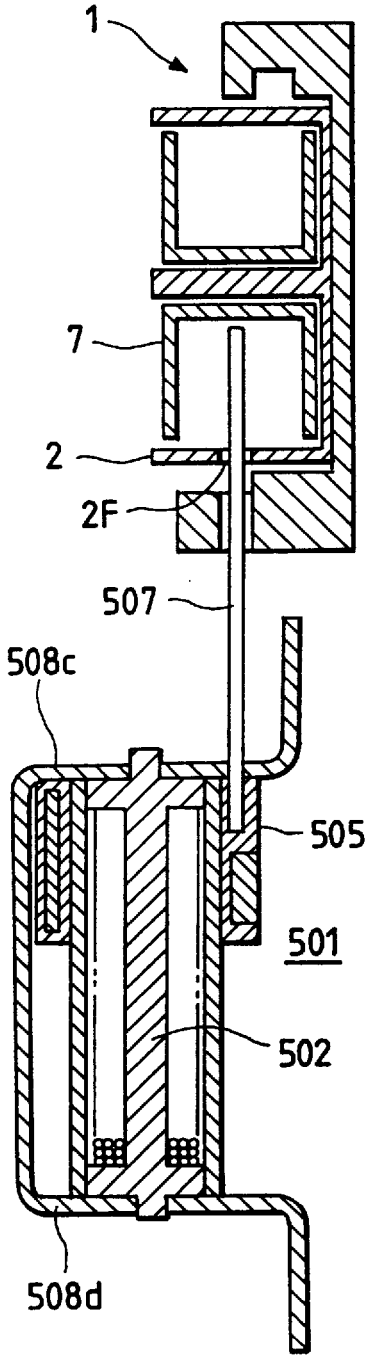
Figure 33:
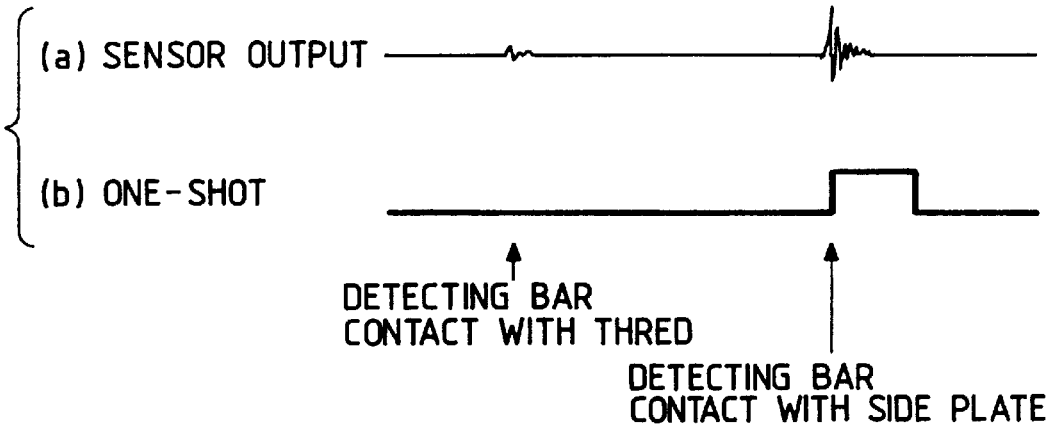
FIG. 33 shows a waveform diagram showing output signals of the residual-thread-amount detecting device when a bobbin contained in a bobbin case has a sufficient amount of thread thereon, and (a) shows a waveform of an output signal of the residual-thread-amount detecting device, and (b) shows a waveform of an output signal of a one-shot generator.
Figure 34:
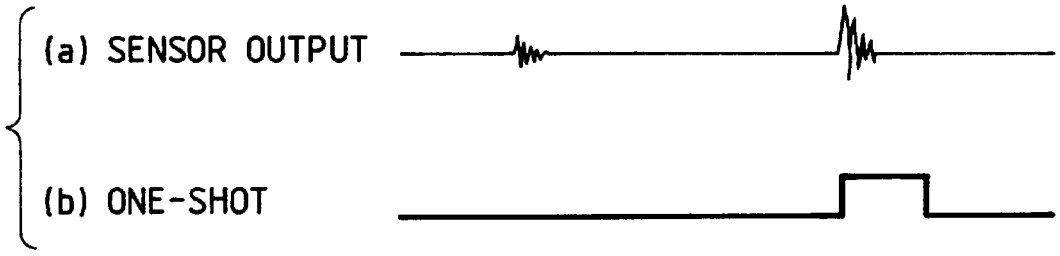
FIG. 34 shows a waveform diagram showing output signals of the residual-thread-amount detecting device when a small amount of thread is left on the bobbin contained in a bobbin case, and (a) shows a waveform of an output signal of the residual-thread-amount detecting device, and (b) shows a waveform of an output signal of the one-shot generator.
Figure 35:
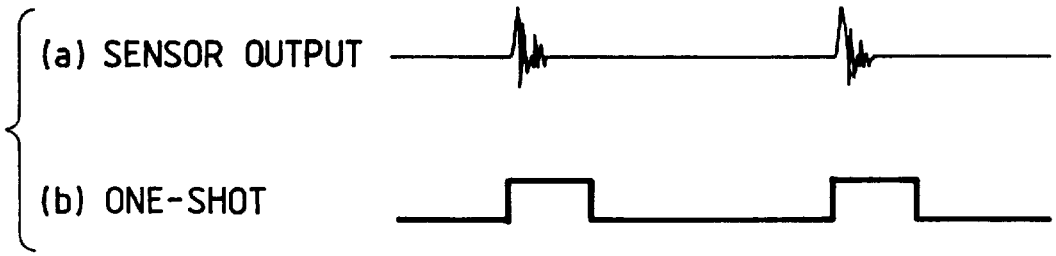
FIG. 35 shows a waveform diagram showing output signals of the residual-thread-amount detecting device when an extremely small amount of thread is left on the bobbin contained in a bobbin case, and (a) shows a waveform of an output signal of the residual-thread-amount detecting device, and (b) shows a waveform of an output signal of the one-shot generator.

As a result of such a movement of the carrier, the end of the detecting bar 507 is inserted into the bobbin case 2 through the detecting-bar holes 1*c* and 2F (FIG. 32(*a*)). At this time, when a sufficient amount of thread is left in the bobbin, the end of the detecting bar 507 hits the outer surface of the wound bobbin thread 150 as shown in FIG. 32(*a*). The ultrasonic wave sensor 509 produces a voltage signal of a small amplitude as shown in FIGS. 34(*a*) and 34(*a*). When the amount of the residual thread is small or so small as to require the bobbin exchange, the carrier 505 collides with the side plate 508*c* closer to the shuttle (FIG. 32(*b*), and the ultrasonic wave sensor 509 produces a voltage signal of a large amplitude (FIG. 35(*a*)). The voltage is compared with the reference voltage, and the one-shot generator circuit 513*b* produces a low (L) signal as a thread present signal (FIGS. 33(*b*) and 34(*b*)) when the residual thread amount is sufficiently large, and produces a high (H) signal as a no thread signal when the amount of the residual thread is small or so small as to require the bobbin exchange (FIG. 35(*b*)).

Accordingly, in a step S6, when a one-shot signal is present (a high signal is produced), controls judges that the bobbin must be exchanged with a new one, and goes to a step S7. In this step, it sets a bobbin exchange flag, and then goes to a step S8. When the one-shot signal is absent (a low signal is produced), control judges that no bobbin exchange is needed, and skips over a step S7 to a step S8. In this step, a drive current DOWN signal is applied to the drive circuit 511, as shown in FIG. 25(*a*). In the next step S9, control waits for several msec, and advances to a step S10. In this step, a drive current UP signal is applied to the drive circuit 511, as shown in FIG. 25(*a*). Then, control goes to a step S11 where it waits for several msec, and goes to a step S12 where a retract signal is applied to the drive circuit as shown in FIG. 25(*b*), and goes to a step S13 where it waits for a preset time, or 30 msec, as in the advancing case (after 30 msec elapses, the drive current becomes a DOWN signal in a step S15 to be given later). Thereafter, as shown in FIG. 25, a part where the drive current UP signal and the retract signal serves as a retract guaranteeing part. This part guarantees the supply of a reverse current from the drive circuit 511 to the coil 503.

Subsequently, the disc-like flange 502*a* located farther from the shuttle serves as an S pole, and the disc-like flange 502*a* closer to the shuttle serves as an N pole. The direction of the propelling force f1 caused by the electromagnet of the iron core 502 is opposite to that of the propelling force f1 in the above case. The propelling force f2 is also opposite in direction to that in the above case. Therefore, the resultant propelling force F1 also is opposite in direction to that in the above case. Accordingly, the carrier 505 moves away from the shuttle. The carrier 505, as shown in FIG. 31, collides with the side plate 508*d* farther from the shuttle, and the ultrasonic wave sensor 509 produces a voltage signal of a large amplitude as when it collides with the side plate 508*c* (FIG. 33(*a*) to FIG. 35(*a*)). The voltage signal is compared with the reference voltage, the one-shot generator circuit 513*b* produces a high signal as a normal movement signal of the movement member (FIGS. 33(*b*) to 35(*b*)). When a trouble occurs and the carrier 505 does not return to the initial position, the ultrasonic wave sensor 509 produces no signal, so that the one-shot generator circuit 513*b* produces a low signal as a no movement signal (abnormal signal) of the movement member.

In a step S14, when no one-shot signal is present (a low signal is produced), control judges that the residual-thread-amount detecting device 500 is abnormal, and proceeds to a step S17. In the step, control sets a residual-thread-amount detecting device abnormal flag and goes to the step S15. In the step S14, if a one-shot signal is present (a high signal is produced), control judges that the residual-thread-amount detecting device 500 is normal, and goes to a step S15. In the step, as shown in FIG. 25(*a*), it sends a drive current DOWN signal and goes to the step S16. In the step, it waits for several msec and returns to the step S11 in the main flow shown in FIG. 28.

Figure 28:
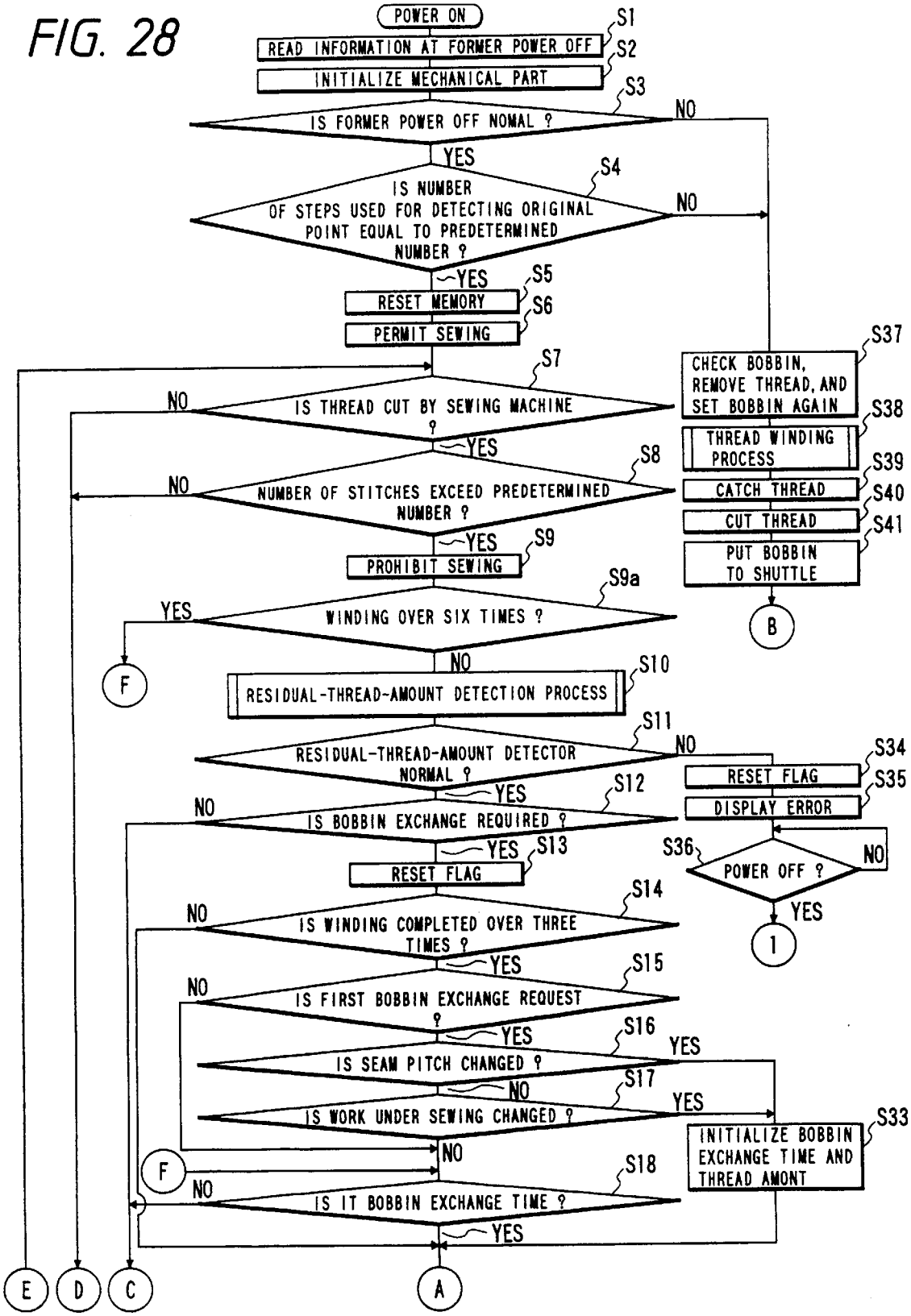
FIG. 28 is a flow chart showing a control flow in the automatic bobbin-thread supplying apparatus.

In the step S11 of FIG. 28, control judges whether or not the residual-thread-amount detecting device 500 is normal. When the residual-thread-amount detecting device abnormal flag is not set in the step S17 of FIG. 30, control goes to a step S12. In the step, control judges whether or not a bobbin request signal is present. When the residual-thread-amount detecting device abnormal flag is set in the step S7 of FIG. 30, control goes to a step S13. In the step, control resets that flag and goes to the step S14.

In the step S14, control judges whether or not a thread is wound at least three times by the bobbin thread winding device 162. The reason why this number is used is as described above. If the thread is wound less than three times, control judges that it is impossible to judge the bobbin exchange time on the basis of the number of stitches and to recognize a change of a seam pattern, and skips over the steps S15 to S18 to a step S19. In the step, a bobbin is exchanged with a new one in accordance with a bobbin exchange request (step S12) issued from the residual-thread-amount detecting device 500. If the thread is wound three times or more in the step S14, control goes to a step S15 for making a more exact judgement on the bobbin exchange. In the step S15, control judges that a bobbin exchange request that is sent to that bobbin from the residual-thread-amount detecting device 500 is a first bobbin exchange request. If it is a first bobbin exchange request, control goes to a step S17 where it judges whether or not a seam pattern is changed to another.

In the step S16, control judges whether or not the expressions (4) and (5) are satisfied. If the expression (4) is satisfied, control judges that a seam pitch is reduced. If the expression (5) is satisfied, it is judged that the seam pitch is increased. Then, control goes to a step S33. In the step, a bobbin exchange time set in a step S23 to be given later and a thread amount Lm wound on the bobbin are initialized, and control advances to the step 19. In the step, a bobbin exchange is performed in accordance with a bobbin exchange request (step S12) produced from the residual-thread-amount detecting device 500. In other words, the bobbin exchange time thus far used is invalid since the seam pattern is changed. It is necessary to set up a bobbin exchange time suitable for the changed seam pattern. To this end, control goes to the step S19 while passing the judging process of the bobbin exchange time in the step S18.

In the step S16, if the expressions (4) and (5) are not satisfied, control judges that no change of the seam pitch is made, and goes to the step S17. In the step, control judges whether or not the expressions (6) and (7) obtained in a step S23 to be given later. If those expressions are satisfied, control judges that a work under sewing is changed to another, and advances to the step S33. If those expressions are not satisfied, control judges that the work under sewing remains unchanged, and proceeds to the step S18.

If a bobbin exchange request derived from the residual-thread-amount detecting device 500 is a second bobbin exchange request or a subsequent one in the step S15, or if the thread is wound six times or more in the step S9*a*, control passes the judgement of the seam pattern change in the steps S16 and S17, and skips to the step S18. In the step, control judges whether or not the expressions (1) to (3) or (8) to (16) are satisfied.

In the step S18, if control judges that the expressions (1) to (3) or (8) to (16) are satisfied, that is, control judges that the bobbin exchange time is reached, control goes to the step S19. In the step, the bobbin is exchanged with a new one. For ease of explanation, one bobbin case held by the bobbin case holding means is denoted as 2Y, and the other bobbin case within the shuttle, as 2X.

At this time, the bobbin case holding means which holds the bobbin case 2Y has been put at the original position (the retract position where it faces the shuttle) by the operation in the step S27. By turning the rotary arm 70 180°, the bobbin case holding means which does not hold the bobbin case is advanced toward the shuttle 1 and picks up the bobbin case 2X from the shuttle, and the rotary arm 70 is moved backward. Then, the rotary arm 70 is turned 180° to confront the bobbin case 2Y with the shuttle 1. Then, the rotary arm 70 is advanced to put the bobbin case 2Y in the shuttle, and the rotary arm 70 is moved backward.

Figure 36:
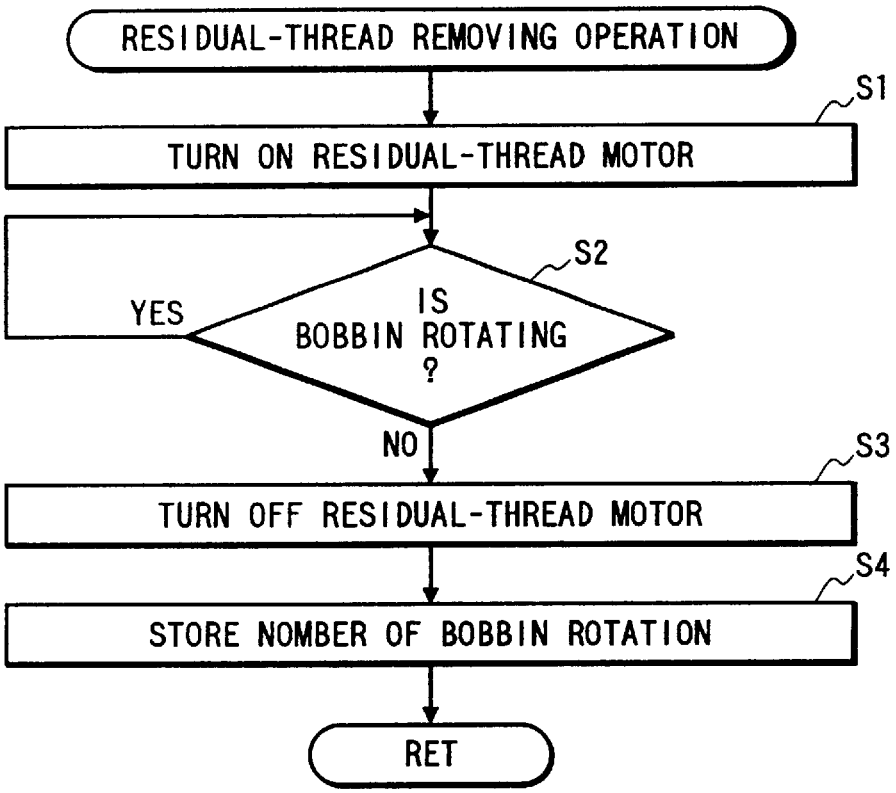
FIG. 36 is a flow chart showing a control flow in the residual thread removing device.

Control goes to a step S20 where it permits the sewing machine 300 to operate, and goes to a step S21. In the step, the rotary arm 70 is turned and advanced to put the bobbin case 2X at the residual thread removing position B, and a residual thread is removed from the bobbin in the bobbin case 2X. The residual thread removing process will be described with reference to a residual thread removing process routine shown in FIG. 36.

In a step S1, a residual thread motor is driven, and a residual thread lead (hanging down) out of the bobbin case 2X is pulled out of the bobbin within the bobbin case. Then, a step S2 is executed. In the step, control judges whether or not the residual thread is removed from the bobbin. When residual-thread amount detecting sensor 161*a* produces a pulse signal, control judges that the residual removing process progresses, and repeats a similar process till no pulse signal is produced. When no pulse signal is produced from the residual-thread amount detecting sensor, control judges that the residual thread removing process is completed, and goes to a step S3.

In the step S3, the residual thread removing motor is stopped, and control goes to a step S4. In the step, the number of revolutions Rz, which is detected by the residual-thread amount detecting sensor 161*a* when the residual thread is removed from the bobbin, is stored, and control returns to a step S22 in the flow chart shown in FIG. 29.

Figure 29:
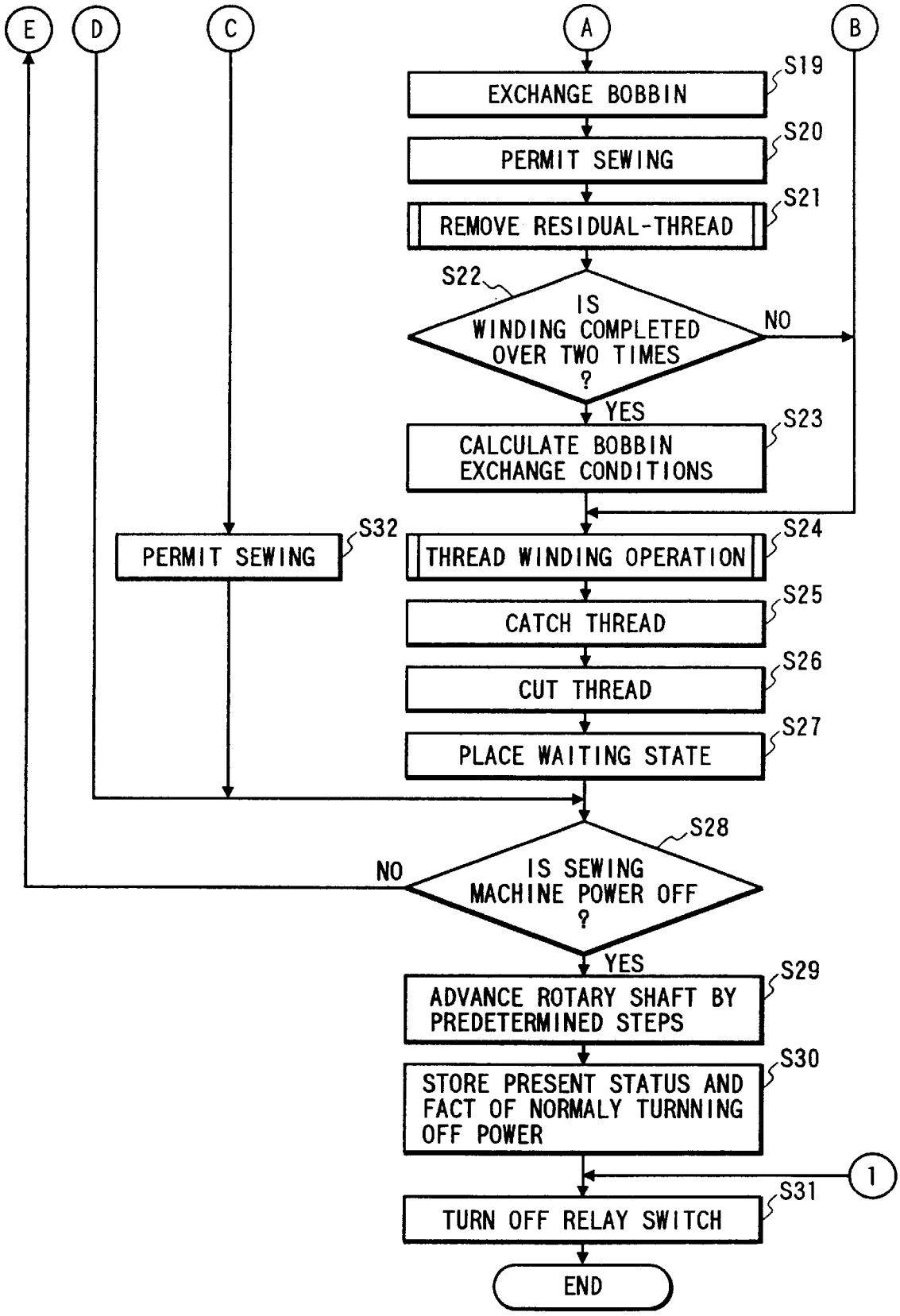
FIG. 29 is a flow chart to be coupled with the flow chart of FIG. 28.

In the step S22 in the FIG. 29 flow chart, control judges whether or not a thread is wound at least two times by the bobbin thread winding device 162. The reason why this number is used is as described above. If the thread is wound less than two times, control judges that it is impossible to set the bobbin exchange time, and skips over a step S23 to a step S24. In the step, a thread winding process is carried out by the bobbin thread winding device 162. If the thread is wound two or more times, control judges that it is possible to set the bobbin exchange time, and goes to the step S23. In the step, the expressions (1) to (3) or (8) to (16) for the bobbin exchange time, are set, and the expressions (4) to (7) for the seam pattern recognition are set.

Then, control advances to the step S24 where a bobbin thread winding (thread winding) process is carried out. This process will be described with reference to a flow chart shown in FIG. 37. The thread winding process is followed by the following operations. A bobbin thread 150, which is led from the thread winder 200 and the tension varying means 204, is wound around the roller 54 by one turn. At this time, the switch of the tension varying means 204 is turned on to maximize a solenoid tension and to minimize a thread tension.

Then, the end of the bobbin thread 150 is inserted into the absorbing hole 65*a* of the thread absorber 65 and slightly pushed thereinto. The electromagnetic valve 68 is temporarily turned on, and air is fed from an air source into the air tubes 66 and 67. The air flow guides the bobbin thread 150, which has been inserted into the absorbing hole 65*a*, to the air nozzle 67*a* until the thread end is protruded from the air nozzle 67*a*. A length of the protruded part of the thread is long enough for the bobbin shaft to catch the thread end, approximately 5 mm in the present embodiment. When the bobbin thread 150, which has been inserted into the absorbing hole 65*a*, is transported, by the air, from the thread absorber 65 to the air nozzle 67*a*, and protruded therefrom, it is preferable that an operator pulls it out the nozzle by a necessary length thereof or manually feeds it out. If so done, a good thread transportation is secured.

Then, in the step S1, the rotary arm 70 is turned to put the bobbin case 2X to the bobbin thread winding position C. Then, control goes to the step S2. In the step, the rotary arm 70 is advanced to put the bobbin case 2X at the bobbin thread winding position C. The bobbin drive motor M2 is temporarily stopped to couple the clutch mechanism 50*a* with the bobbin 7.

In the next step S3, the bobbin drive motor M2 is driven to turn the bobbin 7. The step S4 is executed. In the step, the air-nozzle retract motor 37 is driven to move the air nozzle 67*a*, which is at the retract position N2, to the work position N1. At this time, the air nozzle 67*a* is confronted with the middle of the bobbin shaft 7*a*.

A step S5 is executed. In the step, the air nozzle 67*a* starts to eject an air stream, and control advances to a step S6 where it waits for a fixed time.

Figure 14:
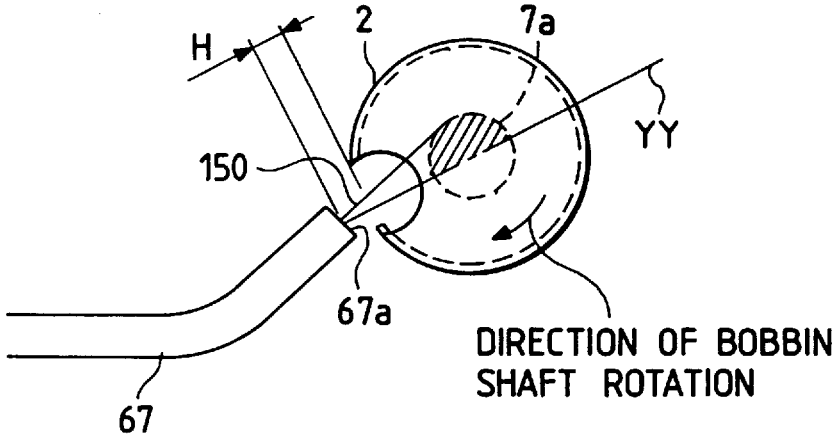
FIG. 14 is an explanatory diagram for showing a relative positions of an air nozzle for thread insertion to a bobbin case and a bobbin shaft when a thread is caught by the bobbin shaft.

As shown in FIG. 14, a part of the thread protruded from the air nozzle 67*a* is well inserted (guided) through the opening 2A of the bobbin case 2 into the bobbin case 2 while being not fluttered. Further, it is guided to the thread winding side XX of the bobbin shaft. With the aid of the rotation of the bobbin shaft 7*a* and the spiral vortex, the shuttle shaft catches the thread at the middle of the shaft (FIG. 38(*a*)).

When the bobbin shaft 7*a* catches the bobbin thread 150 led from the thread winder 200, the roller 54 starts to turn, and the photo sensor 60 produces a pulse signal.

Thereafter, in a step S7, control judges whether or not the effective thread winding amount detecting means 61 counts a preset number of pulses for the preset time period. In the present embodiment, when one or more pulses are detected, or when the bobbin 7 is rotated one or more turns, it is determined that the thread gets wound around the middle of the bobbin shaft 7*a*. When one or more pulses are not detected, control goes to a step S11 to be given later. In the embodiment, at least one pulse is detected. The reason for this is that if a number of pulses are detected and the thread gets wound around the middle of the bobbin shaft many turns, the thread that will subsequently be wound on the bobbin shaft will take a barrel shape.

Control advances to a step S8. In the step, the bobbin case holding means is slightly advanced (moved to the right in FIG. 38), so that the air nozzle 67*a* is confronted with the end (the left end in FIG. 38) 7*aa* of the bobbin shaft 7*a* closer to the bobbin case holding means. Then, control goes to a step S9 where it waits for a fixed time. During this waiting time, the bobbin 7 is rotating. Accordingly, the bobbin thread 150 gets wound round the middle of the bobbin shaft 7*a* and progressively wound on the bobbin shaft toward the end 7*aa* of the bobbin shaft closer to the bobbin case holding means.

Control proceeds to a step S10. In the step, control judges whether or not a preset number of pulses are counted for a fixed time period (the bobbin 7 is rotated four to five turns). If the answer is NO, control judges that the thread fails to get wound round the bobbin shaft 7*a*, and advances to a step S11. In the step, the air ejection from the air nozzle 67*a* is stopped, and control goes to a step S12. In the step, the stepping motor 37 is driven to move the air nozzle 67*a* from the work position N1 to the retract position N2, and control advances to a step S13. In the step, the bobbin drive motor M2 is stopped, and control executes a step S14. In this step, the rotary arm 70 is moved backward, to decouple the clutch mechanism 50*a* from the bobbin 7. And control returns to the step S2 and makes a retry.

Figure 37:
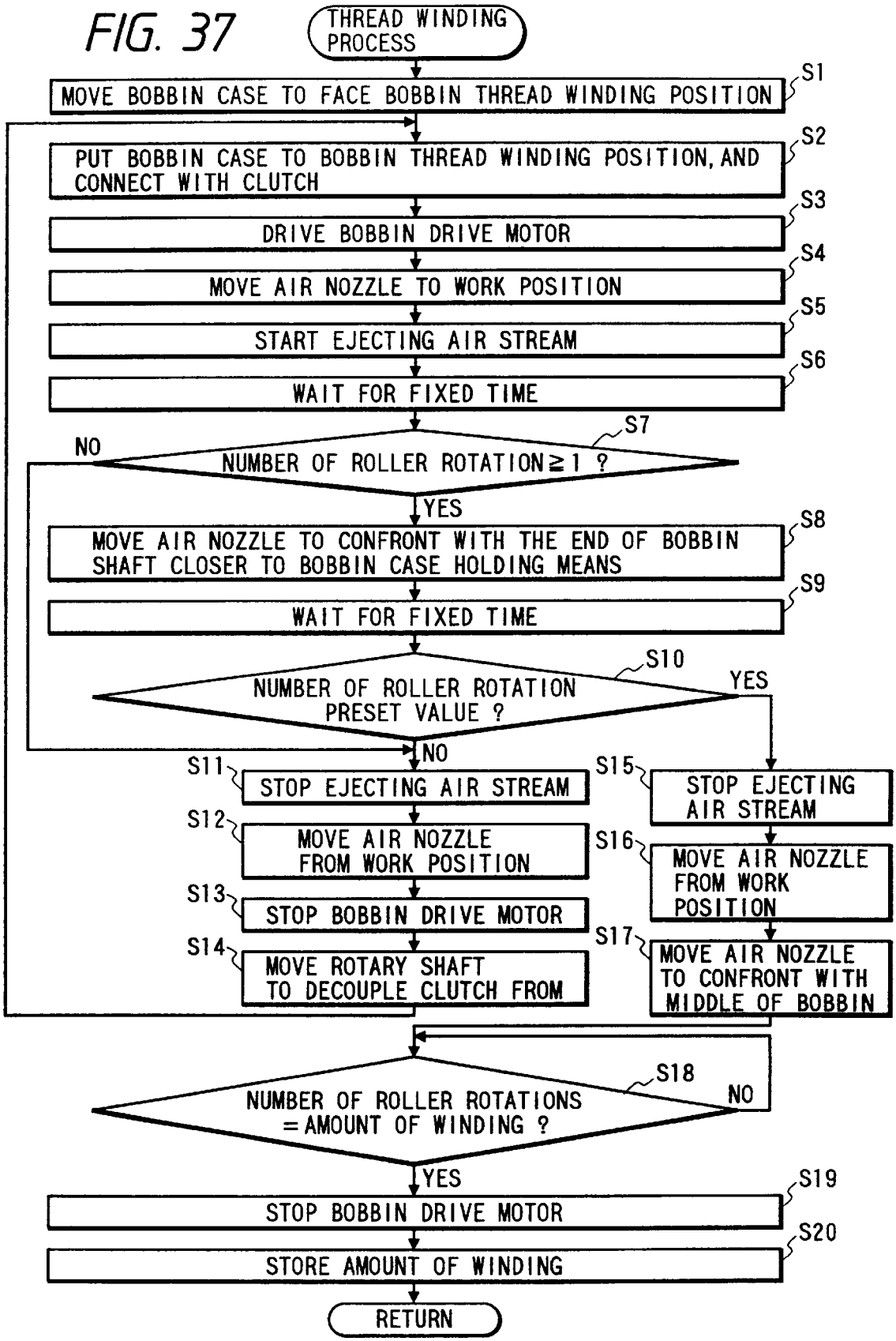
FIG. 37 is a flow chart showing a control flow in the bobbin thread winding device.

In the step S10, when a preset number of pulses are counted for the preset time period, control judges that the winding as shown in FIG. 37(*b*) is successfully made, and control advances to a step S15. In this step, the air ejection from the air nozzle 67*a* is stopped, and control executes the step S16. In this step, the stepping motor 37 is driven to move the air nozzle 67*a* from the work position N1 to the retract position N2, and control goes to a step S17. In this step, the bobbin case holding means is slightly moved backward to a position where the air nozzle 67*a* is confronted with the middle of the bobbin shaft 7*a*, that is, its original position. Incidentally, the clutch mechanism 50*a* is not pulled out of the holes 7X of the bobbin if the bobbin is moved forward and backward by the bobbin case holding means.

In this way, the air nozzle 67*a* is confronted with the middle of the bobbin shaft 7*a*, and a thread is progressively wound round the bobbin shaft 7*a* from a position considerably spaced from the bobbin shaft 7*a*, the bobbin thread 150 that is wound on the end 7*aa* of the bobbin shaft 7*a* closer to the bobbin case holding means is progressively wound thereon toward the end of the bobbin shaft farther from the bobbin case holding means (closer to the clutch mechanism 50*a*: the left side in FIG. 38). The thread comes in contact with the bobbin flange 7*b* located farther from the bobbin case holding means, and progressively wound toward the bobbin case holding means (right side in FIG. 38). This winding operation is repeated. Finally, the thread is orderly wound in a multilayered fashion.

In a step S18, the judging means 61B compares an actual thread winding amount detected by the effective thread winding amount detecting means 61 with the set thread winding amount already entered from the bobbin-thread amount setting means 61A, and judges if both winding amounts are equal to each other. If those are not equal, or the actual thread winding amount does not equal the set thread winding amount, such a judgement is repeated until both the winding amounts are equal. If both the thread winding amounts are equal, control goes to a step S19 where the bobbin drive motor M2 is stopped. Here, the thread has been wound to have the volume equal to the set thread winding amount entered from the bobbin-thread amount setting means 61A.

Thus, the bobbin thread 150 is automatically wound on the bobbin 7. Then, control executes a step S20 where the number of revolutions Rm of the roller 54 is stored, and control returns to the step S25 in the flow chart of FIG. 29.

In the step S25 in the FIG. 29 flow chart, the switch of the tension varying means 204 is turned off to remove the solenoid propelling force and to maximize thread tension. Under this condition, the thread-catching is performed. A bobbin thread 150, which is led from the thread winder 200, wound on the bobbin 7, and led out through the opening 2A, is guided to the slit 2C, through the gap between the opening end of the bobbin case 2 and the outer circumference of the bobbin 7, and finally led out from a location near the hole 2E for a bobbin thread tension spring through the thread leading-out hole 2H that is located under the thread tension spring 2D.

After the thread catching operation is completed, control goes to a step S26. In this step, the air nozzle 67*a* is moved from the retract position N2 to the thread-cutting position N5. The switch of the tension varying means 204 is turned on, to maximize the solenoid propelling force and to minimize the thread tension. Under this condition, the thread is cut. As the result of the thread cutting, a length of the bobbin or lower thread necessary for forming seams by intertwining of the bobbin or bobbin thread with the upper thread, approximately 40 mm, is led out from a location near the tension-spring hole 2E, through the thread leading-out hole 2H that is located under the thread tension spring 2D. On the other hand, the lower thread from the thread winder 200 of a length LL necessary for the thread to get wound around the bobbin shaft 7*a*, about 55 mm is protruded from the air nozzle 67*a*.

Since the length LL necessary for the thread to get wound around the bobbin shaft 7*a* is protruded from the air nozzle 67*a*, the thread can be wound on the next bobbin (the subsequent ones) in a similar way. Then, the air nozzle 67*a* is moved from the thread-cutting position N5 to the retract position N2. After the automatic thread cutting operation is completed, control advances to a step S27. In the step, the rotary arm 70 is retracted to the retract position, and turned to confront the bobbin case 2X with the shuttle 1. Here, the automatic bobbin-thread supplying apparatus is placed in a waiting state.

Control advances to a step S28 where it judges whether or not the machine power switch 302 is turned off. Thus, even if the machine power switch 302 is turned off during the process executions by the respective devices in the steps S10 to S26, the processes of the steps S10 to S26 are completed and the apparatus is placed to a ready-for bobbin exchange state.

When the thread cutting is not yet carried out in the step S7 or when the number of stitches in an actual sewing operation is still below the entered number of stitches in the step S11, control goes to a step S28. When in the step S12, control judges that the bobbin exchange request flag is not yet set in the step S7 in FIG. 30, control goes to a step S32 where it permits the sewing machine 300 to operate, and advances to the step S28. When the machine power switch 302 is turned on in the step S28, control returns to the step S7. Specifically, when the machine power switch 302 is turned on, the bobbin case 2X held by the bobbin case holding means is put at the original position, and the apparatus waits for the generation of a thread cutting signal. When control judges that the machine power switch 302 is turned off, that is, an operator turns off the machine power switch, control goes to a step S30.

In the step S29, the rotary arm 70 is advanced to a position where the bobbin case 2X is confronted with the shuttle 1 as shown in FIG. 39. In this state, an operator cannot access to the bobbin case 2X and the bobbin case 2Y set in the shuttle unless the rotary arm 70 is manually retracted or turned. In the present invention, when the bobbin case is at this position, an obstacle is located near the bobbin case holding means. For this reason, the rotary arm 70 is prohibited from being turned.

The step S30 is then executed. In the step, the present status is stored into the RAM (nonvolatile memory) 308, and the fact that a normal power shut-off process has been carried out is stored in the same. Control goes to a step S31 where the relay switch 303 is turned off to interrupt the power source to the automatic bobbin-thread supplying apparatus per se.

When in the step S11, control judges that the residual-thread-amount detecting device abnormal flag is set in the step S17 in FIG. 30, control goes to a step S34 in the flow chart shown in FIG. 28 where it resets the flag, and advances to a step S35. In this step, the display means 316 displays an error to urge an operator to take some measure. Then, control goes to a step S36. In this step, control waits till the operator turns off the machine power switch 302, and after it is turned off, advances to the step S31 in the flow chart shown in FIG. 29. In this step, the relay switch 303 is turned off to interrupt the power source to the automatic bobbin-thread supplying apparatus per se.

Thereafter, the machine power switch 302 is turned on again, and control returns to the step S i shown in FIG. 28. In the step, information as to whether or not the preceding power interruption is based on a normal power interrupting process is read out of the RAM 308.

The step S2 is executed. In the step, the basic initializing operations of the related mechanisms are performed in the most efficient manner. After the initializing operations are completed, control advances to the step S3 where it judges whether or not the preceding power interruption is based on a normal power interrupting process. If the answer is YES, control proceeds to the step S4.

In the step S4, the rotary arm 70 is retracted by a preset number of steps to detect an original point, and control judges whether or not the number of steps used for the detecting the original point is equal to the number of steps for the above-mentioned case (step S29). When the operator takes out the bobbin case 2X, and the bobbin case 2Y from the shuttle when the machine power switch 302 is in an off state, the rotary arm 70 is not at the position where it approaches to the shuttle 1. Therefore, the original point is detected at the number of steps different from that in the above-mentioned case. When the operator does not take out the bobbin case 2X, and the bobbin case 2Y from the shuttle, the rotary arm 70 is at the position where it approaches to the shuttle 1. Therefore, the rotary arm 70 is returned to the original point at the number of steps equal to that in the above-mentioned case. And control advances to the step S5.

When in the step S3, an accidental power breakdown takes place or the power interruption is not based on a normal power interrupting process because of the residual-thread-amount detecting device 500 is abnormal, control causes the display means 316 to display an error and urges an operator to take some measure, and goes to the step S37. Also when in the step S4, the original point is detected at the different number of steps, that is, the operator may take out the bobbin cases 2X and 2Y, control causes the display means 316 to display an error and urges an operator to take some measure, and goes to the step S37.

The operator clears the error display and carries out a proper return process. That is, he checks all the bobbins used and removes the residual thread from all the bobbins. And he successively sets all the bobbin cases containing the used bobbins to the dummy shaft 6. In setting the bobbins to the dummy shaft 6, the operator brings his hand close to the dummy shaft 6 from the rotary arm side, and sets the bobbins to the dummy shaft without reversing the palm of his hand.

Check is made as to whether or not a bobbin case containing a first bobbin is reliably set to the dummy shaft 6. There are many methods to make the check. In a first method, the operator turns on a bobbin setting switch (not shown). The result of the switching is used for the check. In a second method, a reflecting type sensor is located near the dummy shaft 6, for example. An output signal from the sensor is used for the check. For ease of explanation, this bobbin case is denoted as 2Y, and the bobbin case to be set to the dummy shaft 6, as 2X.

If in the step S37, the bobbin case 2Y is set to the dummy shaft 6, control advances to the step S38. In the step, the bobbin case holding means is confronted with the dummy shaft 6, and advanced. The bobbin case 2Y set to the dummy shaft 6 is held by the bobbin case holding means, and the holding means is retracted. By turning the rotary arm 70, the bobbin case 2Y is aligned with the bobbin thread winding position C, and advanced to the position C. A thread winding process as in the step S24 is carried out. Then, control goes to a step S39 where it executes a thread process as in the step S25, and advances to a step S40 where it executes a thread cutting process as in the step S26, and advances to a step S41. In this step, control causes the bobbin case 2Y to be set to the shuttle 1, and checks if the bobbin case 2X is set to the dummy shaft 6. If it is set, control advances to the step S24. The control carries out a process to wind a thread on the bobbin the bobbin case 2X, and carries out the step S24 process and subsequent ones.

Through the operations by the steps S38 to S41, and S24 to S27, one bobbin is wound by a thread by the bobbin thread winding device 162 and is set to the shuttle, while the other bobbin is put in a stand-by state.

As seen from the foregoing description, in the present embodiment, the residual thread removing device 161 as a residual-thread amount detecting means detects an amount of thread left in a bobbin taken out of a sewing machine. The bobbin exchange time setting means 309 sets a time to exchange a bobbin set in the sewing machine with a new one to a bobbin exchange time at which an amount of thread providing a maximum of sewing is left in the bobbin, on the basis of the detected thread amount. With such an arrangement, a bobbin exchange time can be set to an optimal time at which a waste of the thread in a bobbin is minimized, irrespective of a kind of thread and/or thread count. Further, a waste of a thread in a bobbin is minimized, with respect to any kinds of thread and/or thread counts, and does not require any skill of an operator for the bobbin exchanging operation.

The bobbin thread winding device 162 winds a predetermined amount of thread around the bobbin shaft used for sewing operation. The residual thread removing device 161 detects an amount of thread left in a bobbin on which a predetermined amount of thread is wound by the thread winding device 162 when the bobbin is used for a sewing operation and taken out of the shuttle 1. The bobbin exchange time setting means 309 sets a time to exchange a bobbin with new one, the bobbin having a predetermined amount of thread wound thereon by the thread winding device 162 and being set in the sewing machine, to a bobbin exchange time at which such an amount of thread providing a maximum of sewing is left in the bobbin, on the basis of an amount of thread wound on the bobbin by the bobbin thread winding device 162, the number of thread cuttings, and a residual thread amount detected by the residual thread removing device 161. Therefore, for a bobbin on which a thread is manually wound or an unknown thread winder, the bobbin exchange judging apparatus judges that the setting of a bobbin exchange time will be incorrect, and does not set the bobbin exchange time until the related processes will be completed. For the bobbin having undergone the necessary processes, the bobbin exchange judging apparatus judges that the setting of a bobbin exchange time will be correct, and sets a bobbin exchange time to an optimal time at which a waste of the thread in a bobbin is minimized, with respect to any kinds of thread an/or thread counts. Further, a reliability of setting the bobbin exchange time is improved, cost to sew is reduced, and any skill of an operator for the bobbin exchanging operation is not required.

When the bobbin-thread amount detecting device 500 generates a bobbin exchange request signal indicating that a small amount of thread is left, the bobbin exchange time setting means 309 judges whether or not the bobbin exchange time set is reached. The amount of residual thread is checked double by the residual-thread amount detecting device 500 and also the bobbin exchange time setting means 309. In cases where the also setting of and judgement on the bobbin exchange time are based on the number of stitchings as described above, presence of dummy stitchings possibly hastens the bobbin exchange time setting means to judge the bobbin exchange time. Such an error can be eliminated by the use of the residual-thread amount detecting device for detecting an actual amount of residual thread independently of the dummy stitchings. A reliability of setting the bobbin exchange time is further improved.

When the seam-pattern change recognizing means 314 recognizes a change of a seam pattern, the bobbin exchange time setting means sets the already reset bobbin exchange time to another bobbin exchange time on the basis of an amount of thread left in the bobbin, which is detected anew by the bobbin exchange time setting means 309. Therefore, no problems arise if the seam pattern is changed. A reliability of setting the bobbin exchange time can further be improved.

When dust, oil or the like sticks to the bobbin, the residual-thread-amount detecting device 500 sometimes wrongly senses a less amount of residual thread as a large amount of residual thread because of dust and oil. However, this erroneous detection causes no problem since in the embodiment, the output signal of the residual-thread-amount detecting device 500 is used only for a trigger to the judgement as to whether or not the bobbin exchange time set by the bobbin exchange time setting means 309 is reached. The bobbin exchange time based on the number of stitches led from the expressions (1) to (3) or (8) to (16) is superior to that based on the output signal of the residual-thread-amount detecting device 500.

When the thread winding by the bobbin thread winding device 162 is carried out six times or more, it is judged that the total number of stitches for each bobbin which allows such an amount of bobbin thread in the bobbin to be used for the sewing as to provide a maximum of sewing is settled down. The bobbin exchange time is determined by the result of comparing the total number of stitches with the number of real time stitches. Subsequently, the residual-thread-amount detecting device 500 is not operated. Therefore, the lifetime of the residual-thread-amount detecting device 500 is increased.

Further, the embodiment of the invention has the following advantage. When a thread gets wound around the bobbin shaft 7*a*, the air nozzle 67*a* is confronted with the middle of the bobbin shaft 7*a*. Accordingly, the thread is reliably caught by the bobbin shaft 7*a*. If the air nozzle 67*a* is confronted with the end 7*aa* of the bobbin shaft 7*a*, the bobbin flange 7*b* sometimes prevents the thread from being caught by the bobbin shaft 7*a*. After the thread is caught by the bobbin shaft 7*a*, the air nozzle 67*a* is confronted with the end 7*aa* of the bobbin 7, and then is spaced apart from the bobbin shaft 7*a*. In this way, the thread is wound in a state that the air nozzle 67*a* is confronted with the middle of the bobbin shaft 7*a*. Accordingly, the thread is orderly wound in a multilayered fashion. The thread thus wound prevents a variation of thread tension and thread entangling, and hence poor sewing owing to them.

Since the thread is orderly wound in a multilayered fashion, a residual thread amount can be more precisely detected when comparing with the barrel shaped thread winding. The winding of the thread starts at the location to which the end of the detecting bar 507 is applied (the end 7*aa* of the bobbin 7 closer to the bobbin case holding means), and the winding start position is fixed thereat. The residual thread amount detecting precision is high particularly when a small amount of thread is left. In case where as the result of the dummy stitching, the judgement on the bobbin exchange time is made earlier than the issuance of a bobbin exchange request by the residual-thread-amount detecting device 500, the bobbin is exchanged in accordance with the bobbin exchange request. Therefore, where the dummy stitching is performed, the bobbin exchange time may be set more precisely by such a high precision residual thread amount detection.

While the present invention has been described using a specific embodiment thereof, it should be understood that the invention is not limited to the above-described embodiment, but may variously be changed, modified and altered within the scope of the appended claims. For example, the setting of and judgement on the bobbin exchange time by the bobbin exchange time setting means 309 may be performed in the following manner. In the step S23 in FIG. 29, as in the above case, an amount Lm of the thread wound on the bobbin, an amount z of residual thread on the bobbin, and a length Ls of actually used thread are calculated, and a length Lp of thread used for one sewing is calculated by using $$Lp=Ls/Nc.$$

And $$(Lz-n)=La$$

(where n: safety coefficient) is calculated. The safety coefficient n is:

100 cm for #40 to #80 of a span thread 50 cm for #8 to #30 of a span thread 200 cm for #40 to #80 of a filament thread 100 cm for #8 to #30 of a filament thread.

The number of stitchings N allowed when a residual thread is used is calculated by using $$N=La/Lp.$$

The number of stitchings is reduced by one allowing for a safety: $N-1 \rightarrow N1$.

N1 is decreased by 1 every thread cutting. Judgement as to whether or not $N1-1=0$ is made in place of the step S18 in FIG. 28.

In the second or subsequent calculation, if $Lz<n$, the number of stitchings is further decreased by 1.

In the second or subsequent calculation, if $Lz \geqq n$, the number of stitchings is further added to the increased part.

The alternative of the setting of and judgement on the bobbin exchange time have useful effects comparable with those in the embodiment described above.

In the above-mentioned embodiment, a fixed amount of thread is wound on the bobbin by the bobbin thread winding device 162. An amount of thread left on the bobbin is detected. The bobbin exchange time is set to an optimal bobbin exchange time at which an amount of thread providing a maximum of sewing is left in the bobbin, on the basis of the detected thread amount. Thus, an optimum length of residual thread is obtained at the bobbin exchange time. Therefore, an amount of thread wound on the bobbin may be changed so as to minimize the residual thread amount in a manner that the bobbin exchange time based on the number of stitches is fixed and an amount of residual thread on the exchanged bobbin is detected. Further, an optimal amount of residual thread may be obtained by simultaneously changing the bobbin exchange time and the amount of thread wound on the bobbin. Here, the optimal amount of residual thread means an amount of residual thread corresponding to the number of stitches (the number of stitches for each seam pattern) every thread cutting. It is preferable to set the amount of residual thread to a value approximate to the optimal amount of residual thread. The optimal residual thread amount may be, for example, about (at least) 40 cm, the thread length necessary for the residual thread removing device 161 to carry out a residual thread removal process.

In the above-mentioned embodiment, the bobbin exchange time is set on the basis of the number of cuttings of the machine, but may be set on the basis of a seam pattern (the number of machine stops) which is more generic than the number of thread cuttings.

What is claimed is:

1. A bobbin exchange judging apparatus comprising:

residual-thread amount detecting means for detecting an amount of thread left in a first bobbin of a sewing machine; and bobbin exchange time setting means for setting a time to exchange the first bobbin in the sewing machine with a second bobbin to an optimal bobbin exchange time at which an amount of thread providing a minimum of usable thread is left in the first bobbin, said optimal bobbin exchange time being set on the basis of the amount of thread detected by said residual-thread amount detecting means.

2. A bobbin exchange judging apparatus comprising:

a bobbin thread winding device for winding a predetermined amount of thread around a first bobbin used for a sewing operation;

residual-thread amount detecting means for detecting an amount of thread left in the first bobbin on which the predetermined amount of thread winding device when the first bobbin being used for the sewing operation is taken out of a shuttle body of the sewing machine;

bobbin exchange time setting means for setting a time to exchange the first bobbin with a second bobbin, the second bobbin having a predetermined amount of thread wound thereon by said thread winding device and being set in the sewing machine, to a bobbin exchange time at which an amount of thread providing a minimum of unusable thread is left in the first bobbin, said bobbin exchange time being set on the basis of a seam pattern and the detected thread amount.

3. The bobbin exchange judging apparatus according to claim 2, further comprising:

a bobbin-thread amount detecting device for detecting an amount of thread in the first bobbin being used for the sewing operation, wherein when said bobbin-thread amount detecting device generates a bobbin exchange request signal indicating that a small amount of thread is left in said first bobbin, wherein said bobbin exchange time setting means judges whether said bobbin exchange time set by said bobbin exchange time setting means has been reached based upon a number of seams to be formed after said bobbin exchange request signal.

4. The bobbin exchange judging apparatus according to claim 1, further comprising:

a bobbin-thread amount detecting device for detecting an amount of thread in the first bobbin being used for the sewing operation, wherein when said bobbin-thread amount detecting device generates a bobbin exchange request signal indicating that a small amount of thread is left in said first bobbin, wherein said bobbin exchange time setting means judges whether said bobbin exchange time set by said bobbin exchange time setting means has been reached based upon a number of seams to be formed after said bobbin exchange request signal.

5. The bobbin exchange judging apparatus according to claims 1, 2, 3 or 4, further comprising:

seam-pattern change recognizing means for recognizing a change of a seam pattern, wherein when said seam-pattern change recognizing means recognizes a change of a seam pattern, said bobbin exchange time setting means resets the bobbin exchange time to a second bobbin exchange time on the basis of a second amount of thread left in the first bobbin, said second amount of thread left in the first bobbin being detected by said residual-thread amount detecting means after said seam-pattern change recognizing means recognizes said change of a seam pattern.

* * * * *

UNITED STATES PATENT AND TRADEMARK OFFICE

CERTIFICATE OF CORRECTION

PATENT NO. : 5,769,016

DATED : June 23, 1998

INVENTOR(S) : Toshinobu Shinozuka

It is certified that error appears in the above-identified patent and that said Letters Patent is hereby corrected as shown below:

Column 8, line 65, delete "like".
Column 24, line 39, change "controls" to --control--.
Column 32, line 33, change "double" to --twice--.
Column 32, line 46, change "sets" to --resets--.

In the claims:

Columns 34, line 57, change "usable" to --unusable--.

Signed and Sealed this

Second Day of February, 1999

*Attest:*

*Attesting Officer*

*Acting Commissioner of Patents and Trademarks*